US011699385B2

(12) United States Patent
Lee et al.

(10) Patent No.: US 11,699,385 B2
(45) Date of Patent: Jul. 11, 2023

(54) DISPLAY DEVICE AND METHOD OF DRIVING THE SAME

(71) Applicant: Samsung Display Co., Ltd., Yongin-si (KR)

(72) Inventors: Dong Won Lee, Yongin-si (KR); Seok Young Yoon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/445,281

(22) Filed: Aug. 17, 2021

(65) Prior Publication Data

US 2022/0084461 A1 Mar. 17, 2022

(30) Foreign Application Priority Data

Sep. 14, 2020 (KR) ..... 10-2020-0117967

(51) Int. Cl.
*G09G 3/32* (2016.01)

(52) U.S. Cl.
CPC ..... *G09G 3/32* (2013.01); *G09G 2310/027* (2013.01); *G09G 2320/045* (2013.01); *G09G 2340/00* (2013.01)

(58) Field of Classification Search
CPC ..... G09G 3/32; G09G 2310/027; G09G 2320/045; G09G 2340/00; G09G 2300/0426; G09G 3/006; G09G 2300/0443; G09G 2300/08; G09G 2320/0295; G09G 2330/08; G09G 2330/10; G09G 2300/0439; G01R 19/16566; G01R 31/2621;
(Continued)

(56) References Cited

U.S. PATENT DOCUMENTS 9,754,538 B2 9/2017 Lee et al.
10,157,573 B2 * 12/2018 Pappas ..... G09G 3/006
(Continued)

FOREIGN PATENT DOCUMENTS

KR 10-2012-0045798 A 5/2012
KR 10-2016-0007875 A 1/2016
(Continued)

OTHER PUBLICATIONS

International Search Report dated Nov. 18, 2021 regarding Korean Application No. PCT/KR2021/011151 corresponding to U.S. Appl. No. 17/445,281 (3 pages).

*Primary Examiner* — Andrew Sasinowski
(74) *Attorney, Agent, or Firm* — Lewis Roca Rothgerber Christie LLP

(57) ABSTRACT

A display device includes: a display unit including pixels, wherein each of the pixels includes stacks connected in series and each of the stacks includes a light emitting element; a storage to store pieces of stack number information, wherein each of the pieces of the stack number information indicates the number of stacks constituting an effective light source from among the stacks for each of the pixels; a compensator to generate compensated data by compensating image data based on the pieces of the stack number information; and a data driver to generate data voltages based on the compensated data and to provide the data voltages to the display unit. The pixels are to emit light with luminances corresponding to the data voltages.

20 Claims, 12 Drawing Sheets

(58) Field of Classification Search
CPC ..... G01R 31/2825; G01R 31/2856; H01L 25/0753; H01L 25/0756; H01L 27/1214
See application file for complete search history.

(56) References Cited

U.S. PATENT DOCUMENTS

| | | | | |
|---|---|---|---|---|
| 2013/0135705 | A1* | 5/2013 | Hong | G09G 3/3233 359/290 |
| 2018/0026218 | A1* | 1/2018 | Kobayashi | G09G 3/3233 349/143 |
| 2019/0165038 | A1* | 5/2019 | Chae | H01L 27/156 |
| 2019/0318685 | A1 | 10/2019 | Park et al. | |
| 2020/0152101 | A1 | 5/2020 | Li et al. | |

FOREIGN PATENT DOCUMENTS

| | | | |
|---|---|---|---|
| KR | 10-2017-0076952 | A | 7/2017 |
| KR | 10-2019-0079141 | A | 7/2019 |
| KR | 10-2019-0119693 | A | 10/2019 |

* cited by examiner

| INFO_S1 | INFO_S2 | | |
|---|---|---|---|
| 2 (0) | 1 (1) | 2 (0) | ··· |
| 2 (0) | 2 (0) | 2 (0) | ··· |
| 2 (0) | 2 (0) | 2 (0) | ··· |
| ⋮ | ⋮ | ⋮ | ⋱ |

LUT

LUT_1

| INFO_S1 | INFO_S2 | INFO_S3 | INFO_S4 |
|---|---|---|---|
| 4 (0) | 3 (1) | 2 (2) | · · · |
| 4 (0) | 4 (0) | 1 (3) | · · · |
| 4 (0) | 4 (0) | 4 (0) | · · · |
| ⋮ | ⋮ | ⋮ | ⋱ |

DISPLAY DEVICE AND METHOD OF DRIVING THE SAME

CROSS-REFERENCE TO RELATED APPLICATION

This application claims priority to and the benefit of Korean Patent Application No. 10-2020-0117967 filed in the Korean Intellectual Property Office on Sep. 14, 2020, the entire content of which is incorporated herein by reference.

BACKGROUND

1. Field

The present disclosure relates to a display device and a method of driving the same.

2. Description of the Related Art

With increasing interest in information displays and increasing demand to use portable information media, demand and commercialization for display devices are being made intensively.

SUMMARY

An aspect of the present disclosure is to provide a display device capable of improving display quality and a method of driving the same.

A display device according to an embodiment of the present disclosure includes: a display unit including pixels, wherein each of the pixels includes stacks connected in series and each of the stacks includes a light emitting element; a storage to store pieces of stack number information, wherein each of the pieces of the stack number information indicates a number of stacks constituting an effective light source from among the stacks for each of the pixels; a compensator to generate compensated data by compensating image data based on the pieces of the stack number information; and a data driver to generate data voltages based on the compensated data and to provide the data voltages to the display unit. The pixels are to emit light with luminances corresponding to the data voltages.

In an embodiment, the pixels may include a first pixel and a second pixel, first stack number information of the first pixel may have a value different from that of second stack number information of the second pixel, and a first data voltage applied to the first pixel for a same luminance as the second pixel may be different from a second data voltage applied to the second pixel.

In an embodiment, as the second stack number information decreases, the second data voltage for the same luminance as the first pixel and a driving current flowing through the light emitting element of the second pixel may increase.

In an embodiment, when the first stack number information is greater than the second stack number information, the compensator may generate a first compensated grayscale value by downscaling a first grayscale value of the first pixel based on a second grayscale value of the second pixel, the image data may include the first grayscale value and the second grayscale value, and the compensated data may include the first compensated grayscale value.

In an embodiment, when the first stack number information is greater than the second stack number information, the compensator may generate a second compensated grayscale value by upscaling a second grayscale value of the second pixel based on a first grayscale value of the first pixel, the image data may include the first grayscale value and the second grayscale value, and the compensated data may include the second compensated grayscale value.

In an embodiment, each of the pixels may include two stacks.

In an embodiment, each of the pixels may further include: a driving transistor connected between a first power line and a second power line, a switching transistor connected between a data line and a gate electrode of the driving transistor; a sensing transistor connected between one electrode of the driving transistor and a sensing line; and a storage capacitor connected between the gate electrode of the driving transistor and the one electrode of the driving transistor. The stacks may be connected between the one electrode of the driving transistor and the second power line.

In an embodiment, the compensator may set the pieces of the stack number information based on a sensing voltage sensed by the one electrode of the driving transistor in response to a reference voltage applied to the gate electrode of the driving transistor.

In an embodiment, when the sensing voltage is within a reference range, the compensator may set corresponding stack number information among the pieces of the stack number information to have a maximum value.

In an embodiment, when the sensing voltage is out of a reference range, the compensator may set corresponding stack number information among the pieces of the stack number information to have a value smaller than a maximum value.

In an embodiment, the sensing voltage may be equal to a value obtained by multiplying a threshold voltage of the light emitting element by a value of the corresponding stack number information.

In an embodiment, each of the pixels may include four stacks.

A method of driving a display device according to an embodiment of the present disclosure may drive a display device including pixels, wherein each of the pixels includes a driving transistor and stacks connected in series to a first electrode of the driving transistor and each of the stacks includes a light emitting element. The method includes: applying a first voltage to the gate electrode of the driving transistor; measuring a second voltage applied to the first electrode of the driving transistor in response to the first voltage; generating stack number information based on the second voltage, wherein the stack number information indicates a number of stacks constituting an effective light source from among the stacks for each of the pixels; and setting a data voltage applied to the gate electrode of the driving transistor based on the stack number information.

In an embodiment, the generating of the stack number information based on the second voltage may include, when the second voltage is within a first reference range, setting the stack number information to have a first value.

In an embodiment, the first reference range may be set based on a total number of the stacks and a threshold voltage of the light emitting element.

In an embodiment, the generating of the stack number information based on the second voltage may include, when the second voltage is out of the first reference range, setting the stack number information to have a second value smaller than the first value.

In an embodiment, the pixels may include a first pixel and a second pixel, first stack number information of the first pixel may have a value different from that of second stack number information of the second pixel, and a first data voltage applied to the first pixel for a same luminance as the second pixel may be different from a second data voltage applied to the second pixel.

In an embodiment, as the second stack number information decreases, the second data voltage for the same luminance as the first pixel and a driving current flowing through the light emitting element of the second pixel may increase.

In an embodiment, the setting of the data voltage may include: when the first stack number information is greater than the second stack number information, generating a first compensated grayscale value by downscaling a first grayscale value of the first pixel based on a second grayscale value of the second pixel; and generating the first data voltage for the first pixel based on the first compensated grayscale value.

In an embodiment, the setting of the data voltage may include: when the first stack number information is greater than the second stack number information, generating a second compensated grayscale value by upscaling a second grayscale value of the second pixel based on a first grayscale value of the first pixel; and generating the second data voltage for the second pixel based on the second compensated grayscale value.

DETAILED DESCRIPTION

Figure 1:
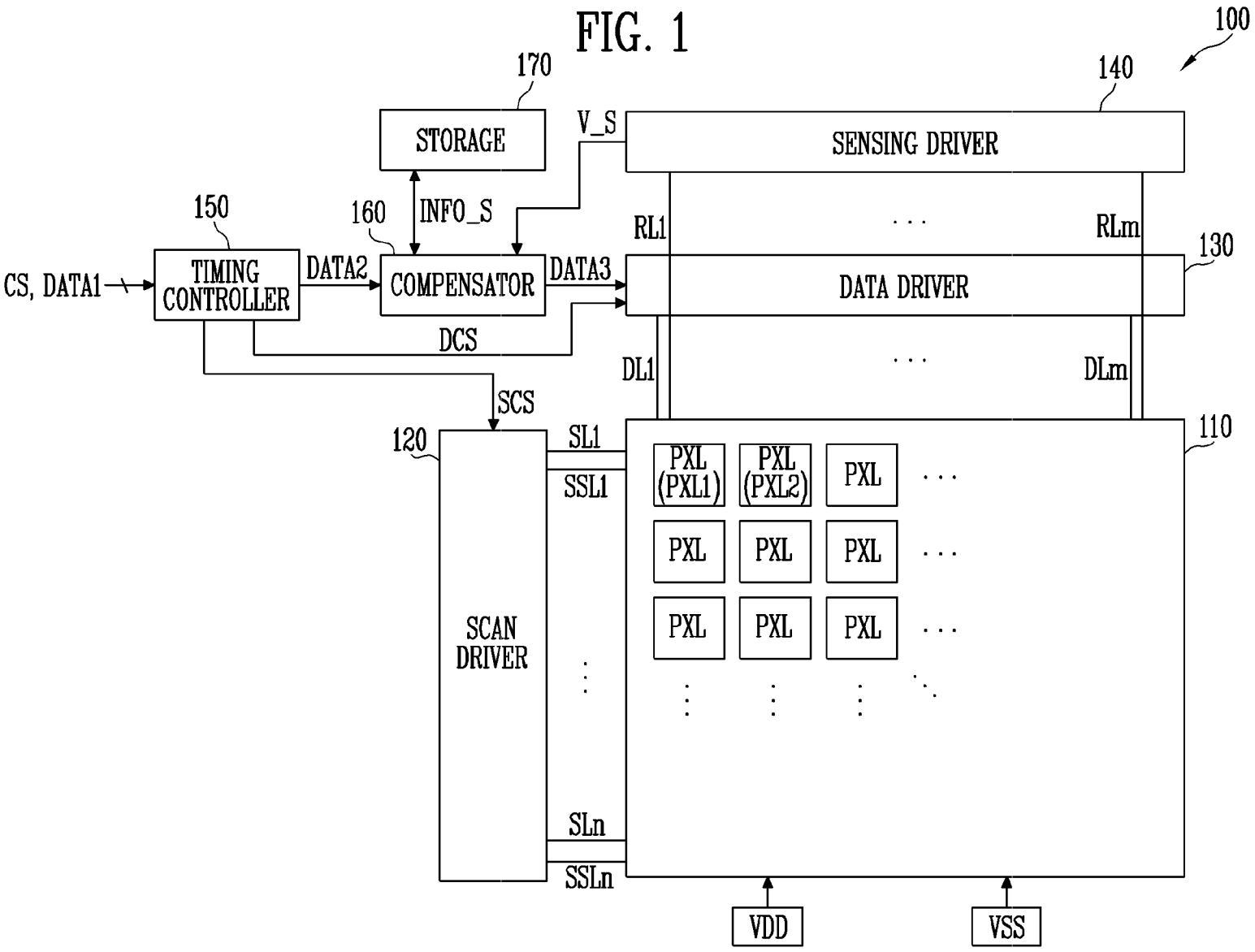
FIG. 1 is a block diagram illustrating a display device according to some embodiments of the present disclosure.

Because the present disclosure may have diverse modified embodiments and forms, specific embodiments are illustrated in the drawings and are described in the detailed description. However, this is not intended to limit the present disclosure to specific embodiments, and it will be understood to include various modifications, equivalents, and/or alternatives falling within the spirit and scope of the present disclosure.

Like reference numerals are used to refer to like elements throughout the drawings. In the accompanying drawings, the dimensions of the structures are more enlarged than actual for clarity of the present disclosure. Furthermore, these terms such as "first," "second," and other numerical terms, are used only to distinguish one element from another element. These terms are used only for the purpose of distinguishing one element from another element. For example, without departing from the scope of the present disclosure, a first element may be referred to as a second element, and similarly, a second element may be referred to as a first element. As used herein, the singular forms "a," "an," and "the" are intended to include the plural forms as well, unless the context clearly indicates otherwise.

The terms "comprises," "comprising," "including," and "having," as used in the present disclosure are inclusive and therefore specify the presence of stated features, integers, steps, operations, elements, components, or combinations thereof, but do not preclude the presence or addition of one or more other features, integers, steps, operations, elements, components, or combinations thereof. It will be understood that when a part such as a layer, film, region, or plate are referred to as being "on" another part, it may be "directly on" the other part or may be "indirectly on" the other part with one or more part intervening parts therebetween. In the present disclosure, it will be understood that when a part such as a layer, film, region, or plate is referred to as being formed "on" another part, the formed direction is not limited only to the upper direction, and includes a lateral or lower direction. In contrast, it will be understood that when a part such as a layer, film, region, or plate are referred to as being "under" another part, it may be "directly under" the other part or may be "indirectly under" the other part with one or more part intervening parts therebetween.

When a certain element (e.g., a first element) is "(operatively or communicatively) coupled with/to" or "connected to" another element (e.g., a second element), it will be understood that the certain element may be connected to the other element directly or through another element (e.g., a third element). When a certain element (e.g., a first element) is "directly coupled with/to" or "directly connected to" another element (e.g., a second element), it will be understood that another element (e.g., a third element) is not present between the certain element and the other element.

Hereinafter, embodiments of the present disclosure and other matters necessary for those with ordinary skill in the art to easily understand the contents of the present disclosure will be described in detail with reference to the accompanying drawings. In the following description, the expression of the singular also encompasses the expression of in the plural unless the context clearly includes only the singular.

FIG. 1 is a block diagram illustrating a display device according to some embodiments of the present disclosure.

Referring to FIG. 1, a display device 100 includes a display unit 110 (or a pixel unit, a display panel, etc.), a scan driver 120, a data driver 130, a sensing driver 140, a timing controller 150, the compensator 160, and a storage 170.

The display unit 110 may include scan lines SL1 to SLn (where n is a positive integer) (or first scan lines), data lines DL1 to DLm (where m is a positive integer), and pixels PXL. The display unit 110 may further include sensing scan lines SSL1 to SSLn (or second scan lines) and sensing lines RL1 to RLm (or readout lines).

The pixels PXL may be provided in areas (e.g., pixel areas) partitioned by the scan lines SL1 to SLn and the data lines DL1 to DLm.

The pixel PXL may be connected to a corresponding one of the scan lines SL1 to SLn and a corresponding one of the data lines DL1 to DLm. In some embodiments, the pixel PXL may be connected to a corresponding one of the sensing scan lines SSL1 to SSLn and a corresponding one of the sensing lines RL1 to RLm. Hereinafter, "connection" includes not only electrical connection but also physical connection, and may include not only direct connection but also indirect connection through other elements.

The pixel PXL may include a light emitting element and at least one transistor for providing or aiming to provide a driving current to the light emitting element.

The pixel PXL may emit light with a luminance corresponding to a data signal (or a data voltage) provided through the data line (e.g., a corresponding one of the data lines DL1 to DLm) in response to a first scan signal provided through the scan line (e.g., a corresponding one of the scan lines SL1 to SLn). In some embodiments, the pixel PXL may output characteristic information of the light emitting element (e.g., a sensing voltage or a sensing current as information about a threshold voltage of a driving transistor) through the sensing line (e.g., a corresponding one of the sensing lines RL1 to RLm) in response to a second scan signal provided through the sensing scan line (e.g., a corresponding one of the sensing scan lines SSL1 to SSLn).

A detailed configuration of the pixel PXL will be described below with reference to FIG. 2.

On the other hand, a first power supply voltage VDD (or a high power supply voltage) and a second power supply voltage VSS (or a low power supply voltage) may be provided to the display unit 110. The first power supply voltage VDD and the second power supply voltage VSS may be voltages required for the operation of the pixel PXL, and the first power supply voltage VDD may have a voltage level higher than that of the second power supply voltage VSS. The first power supply voltage VDD and the second power supply voltage VSS may be provided from a separate power supply (or power management integrated circuit (PMIC)).

The scan driver 120 may generate a scan signal (or the first scan signal) based on a scan control signal SCS and may sequentially provide the scan signal to the scan lines SL1 to SLn. In this case, the scan control signal SCS may include a scan start pulse, scan clock signals, and the like, and may be provided from the timing controller 150. For example, the scan driver 120 may include a shift register for sequentially generating and outputting a pulsed scan signal corresponding to a pulsed scan start signal (e.g., a gate-on voltage level pulse for turning on a transistor) using the scan clock signals.

Similar to the scan signal, the scan driver 120 may further generate a sensing scan signal (or the second scan signal) and sequentially provide the sensing scan signal to the sensing scan lines SSL1 to SSLn.

The data driver 130 may generated data signals (or data voltages) based on a data control signal DCS provided from the timing controller 150 and compensated data DATA3 provided from the compensator 160, and may provide the data signals to the data lines DL1 to DLm. In this case, the data control signal DCS is a signal for controlling the operation of the data driver 130 and may include a load signal (or a data enable signal) instructing to output an effective data voltage.

In an embodiment, the data driver 130 may generate a data signal (or a data voltage) corresponding to a data value (or a grayscale value) included in the compensated data DATA3 using gamma voltages. In this case, the gamma voltages may be generated by the data driver 130 or may be provided from a separate gamma voltage generation circuit (e.g., a gamma integrated circuit). For example, the data driver 130 may select one of the gamma voltages based on the data value and output the selected gamma voltage as the data signal.

The sensing driver 140 may provide an initialization voltage to the sensing lines RL1 to RLm in a sensing mode (or a sensing period), and may sense light emission characteristics of the pixel PXL through the sensing lines RL1 to RLm.

For reference, the display device 100 may operate in the sensing mode (or the sensing period) or the display mode (or the display period). In the display mode, the display device 100 may provide the data voltage to the pixel PXL so that the pixel PXL emits light, and in the sensing mode, the display device 100 may sense light emission characteristics of the pixel PXL. The sensing time corresponding to the sensing mode may be allocated before or after the display period. In some cases, the display period and the sensing period may be included in one frame (or frame period).

The light emission characteristics of the pixel PXL may include a threshold voltage, mobility, and characteristic information (e.g., current-voltage characteristics) of at least one transistor (e.g., the driving transistor) in the pixel PXL. For example, the sensing driver 140 may detect a sensing value V_S (e.g., a sensing voltage, a sensing current, sensing data, etc.) corresponding to the light emission characteristics of the pixel PXL through the sensing lines RL1 to RLm.

The sensing value V_S may be provided to the compensator 160 (or the timing controller 150), and the compensator 160 (or the timing controller 150) may compensate image data DATA2 (or input image data DATA1) based on the sensing value. However, the present disclosure is not limited thereto. For example, the sensing value V_S may be provided from the sensing driver 140 to the data driver 130, and the data driver 130 may generate the data voltage based on the sensing value V_S. For example, the data driver 130 may change or compensate the data voltage based on the change amount of the sensing value V_S. That is, the data voltage may be compensated based on the light emission characteristics (or the change in the light emission characteristics) of the sensed pixel PXL.

The timing controller 150 may receive the input image data DATA1 and the control signal CS from the outside (e.g., an application processor), may generate the scan control signal SCS and the data control signal DCS based on the control signal CS, and may convert the input image data DATA1 to generate the image data DATA2. In this case, the control signal CS may include a vertical synchronization signal, a horizontal synchronization signal, a clock signal, and the like. For example, the timing controller 150 may convert the input image data DATA1 into the image data DATA2 having a format that is usable by the data driver 130.

The compensator 160 may generate stack number information INFO_S based on the sensing value V_S provided from the sensing driver 140.

In this case, the stack number information INFO_S may indicate the number of stages (or stacks, including a plurality of light emitting elements connected in parallel) that are connected in series within each of the pixels PXL to constitute an effective light source. As will be described below with reference to FIG. 2, one light source may include a plurality of stages. In some cases, some stages may not contribute to constituting the effective light source due to connection defects (e.g., short-circuit). The stack number information INFO_S may indicate the number of stages (i.e., normally aligned stages) that contribute to constituting the effective light source, excluding some defective stages.

However, the stack number information INFO_S is not limited thereto. For example, the stack number information INFO_S may indicate the number of some stages (e.g., defective stages) that do not contribute to constituting the effective light source from among the stages of the pixel PXL.

As will be described below with reference to FIG. 5, when the light source includes some defective stages, the sensing value V_S of the corresponding pixel PXL (e.g., the sensing value corresponding to the threshold voltage of the driving transistor) may be out of an expected sensing value range, that is, a reference range (e.g., a deviation or shiftable range of the threshold voltage of the driving transistor). When the sensing value V_S is out of the reference range, it may be determined that defects have occurred in some stages, and the number of stages contributing to constituting the effective light source may be calculated based on the sensing value V_S.

The stack number information INFO_S and the configuration for calculating the stack number information INFO_S will be described below with reference to FIGS. 6 and 7.

On the other hand, the stack number information INFO_S may be stored in the storage 170 and may be provided from the storage 170 to the compensator 160.

In some embodiments, the compensator 160 may compensate the image data DATA2 based on the stack number information INFO_S to generate compensated data DATA3.

In some embodiments, when first stack number information of a first pixel PXL1 has a value different from that of second stack number information of a second pixel PXL2, the compensator 160 may compensate at least one of a first grayscale value of the first pixel PXL1 and a second grayscale value of the second pixel PXL2 based on the first stack number information and the second stack number information.

In an embodiment, when the first stack number information of the first pixel PXL1 has a value larger than that of the second stack number information of the second pixel PXL2, the compensator 160 may decrease the first grayscale value of the first pixel PXL1 by a specific ratio based on the second grayscale value of the second pixel PXL2. In this case, the specific ratio may be a ratio of the value of the second stack number information to the value of the first stack number information. For example, when the first stack number information of the first pixel PXL1 has a value of 2 and the second stack number information of the second pixel PXL2 has a value of 1, the compensator 160 may decrease the first grayscale value of the first pixel PXL1 by ½ times.

For reference, when the same driving current flows through the first pixel PXL1 and the second pixel PXL2, the first stack number information of the first pixel PXL1 has a value larger than that of the second stack number information of the second pixel PXL2, and thus, the first pixel PXL1 may emit light with a luminance higher than that of the second pixel PXL2. Therefore, based on the second pixel PXL2 emitting light with a relatively low luminance, the first grayscale value of the first pixel PXL1 may be decreased so that the first pixel PXL1 emits light with substantially the same luminance as that of the second pixel PXL2. In this case, the total luminance of the display device 100 may be reduced, but the deterioration in display quality due to the deviation in the stack number information (e.g., spots due to the difference in luminance) may be improved. In some embodiments, because the driving current flowing through the first pixel PXL1 is relatively reduced according to the decreased first grayscale value, stress (or light emission stress) of the first pixel PXL1 (and the pixels PXL) may be reduced and the lifetime of the first pixel PXL1 (and the pixels PXL) may be improved.

In an embodiment, when the first stack number information of the first pixel PXL1 has a value larger than that of the second stack number information of the second pixel PXL2, the compensator 160 may increase the second grayscale value of the second pixel PXL2 by a specific ratio based on the first grayscale value of the first pixel PXL1. For example, when the first stack number information of the first pixel PXL1 has a value of 2 and the second stack number information of the second pixel PXL2 has a value of 1, the compensator 160 may increase the second grayscale value of the second pixel PXL2 by twice.

That is, based on the first pixel PXL1 emitting light with a relatively high luminance, the second grayscale value of the second pixel PXL2 may be increased so that the second pixel PXL2 emits light with substantially the same luminance as that of the first pixel PXL1. In this case, the total luminance of the display device 100 is not reduced and is substantially maintained at a desired luminance, and the deterioration in display quality due to the deviation in the stack number information (e.g., spots due to the difference in luminance) may be improved.

In an embodiment, when the first stack number information of the first pixel PXL1 has a value larger than that of the second stack number information of the second pixel PXL2, the compensator 160 may decrease the first grayscale value of the first pixel PXL1 and increase the second grayscale value of the second pixel PXL2. For example, when the first stack number information of the first pixel PXL1 has a value of 2 and the second stack number information of the second pixel PXL2 has a value of 1, the compensator 160 may decrease the first grayscale value of the first pixel PXL1 by 0.75 times and increase the second grayscale value of the second pixel PXL2 by 1.5 times.

The storage 170 may store the stack number information INFO_S and the light emission characteristics (e.g., the threshold voltage of the driving transistor, mobility, etc.) for each pixel PXL.

The storage 170 may be implemented as a non-volatile memory device, such as erasable programmable read-only memory (EPROM), electrically erasable programmable read-only memory (EEPROM), flash memory, phase change random access memory (PRAM), resistance random access memory (RRAM), nano floating gate memory (NFGM), polymer random access memory (PoRAM), magnetic random access memory (MRAM), and ferroelectric random access memory (FRAM).

As described above with reference to FIG. 1, the display device 100 may generate the stack number information INFO_S for each pixel PXL through the compensator 160 and compensate the image data DATA2 based on the stack number information INFO_S to generate the compensated data DATA3. Therefore, the deterioration in display quality due to the deviation in the number of stages (e.g., effective stages) of pixels (i.e., stages constituting the effective light source) may be alleviated or improved.

In some embodiments, the display device 100 may improve the lifetime of the pixel PXL by compensating (or decreasing) the first grayscale value of the first pixel PXL1 corresponding to the relatively large first stack number information compared to the second grayscale value of the second pixel PXL2 corresponding to the relatively small second stack number information.

Furthermore, when necessary, the display device 100 may improve display quality by compensating (or increasing) the second grayscale value of the second pixel PXL2 corresponding to the relatively small second stack number information compared to the first grayscale value of the first pixel PXL1 corresponding to the relatively large first stack number information.

FIG. 1 illustrates that the scan driver 120, the data driver 130, the sensing driver 140, the timing controller 150, and the compensator 160 are configured independently of each other, but this is an example and the present disclosure is not limited thereto. For example, at least one of the scan driver 120, the data driver 130, the sensing driver 140, the timing controller 150, and the compensator 160 may be formed on the display unit 110 or implemented as an IC, and may be mounted on a flexible circuit board and connected to the display unit 110. For example, the scan driver 120 may be formed on the display unit 110. In some embodiments, at least two of the scan driver 120, the data driver 130, the sensing driver 140, the timing controller 150, and the compensator 160 may be implemented as one IC. For example, the data driver 130 and the sensing driver 140 may be implemented as one integrated circuit. As an example, the timing controller 150 and the compensator 160 may be implemented as one integrated circuit.

Figure 2:
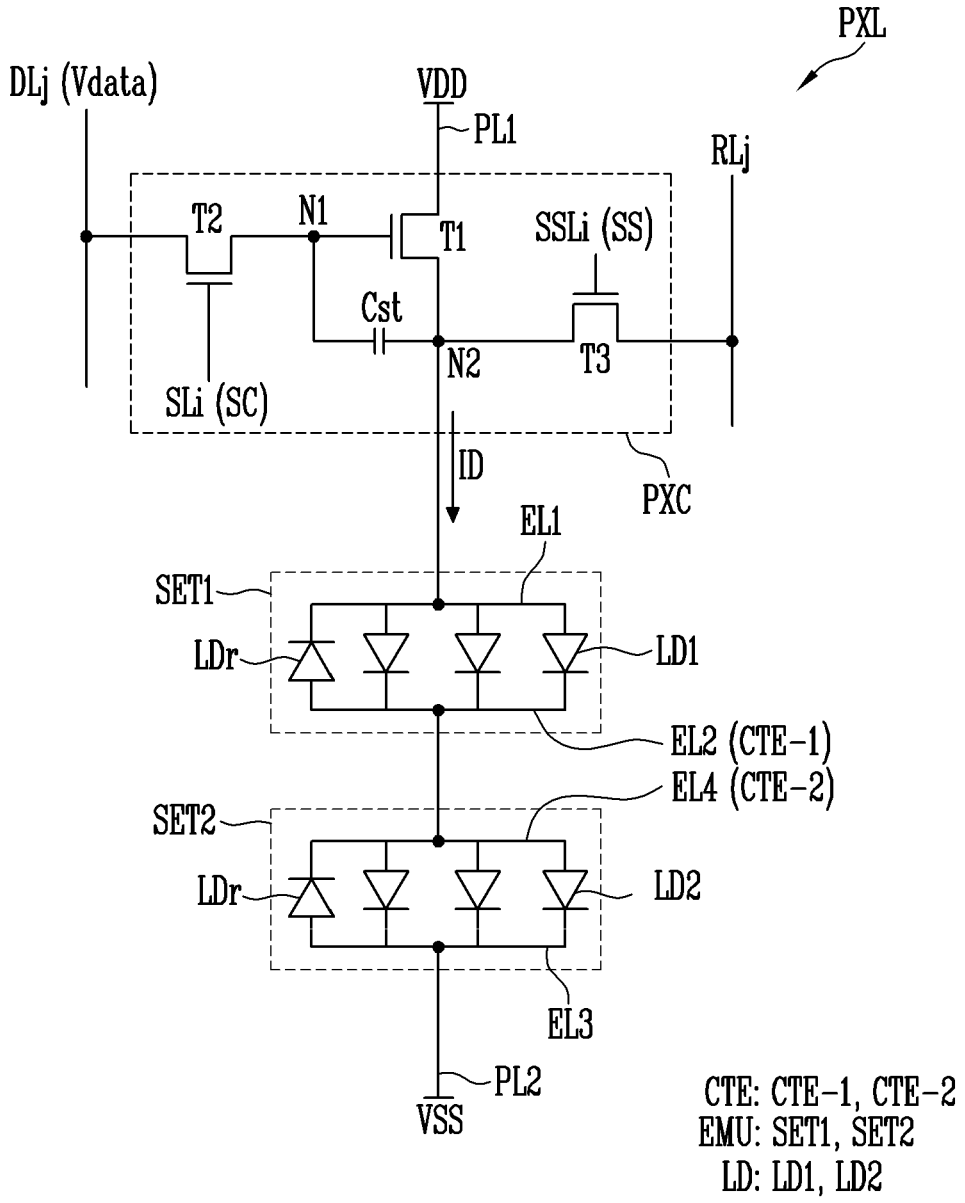
FIG. 2 is a circuit diagram illustrating an example of a pixel included in the display device of FIG. 1.

FIG. 2 is a circuit diagram illustrating an example of the pixel included in the display device of FIG. 1.

Referring to FIG. 2, the pixel PXL may include a light emitting unit EMU that generates light of a luminance corresponding to a data signal. In some embodiments, the pixel PXL may optionally further include a pixel circuit PXC for driving the light emitting unit EMU.

The light emitting unit EMU may include a plurality of light emitting elements LD connected in parallel between a first power line PL1 to which the first power supply voltage VDD is applied and a second power line PL2 to which the second power supply voltage VSS is applied. For example, the light emitting unit EMU may include a first electrode EL1 (or a first alignment electrode) connected to the first power line PL1 via the pixel circuit PXC, a third electrode EL3 (or a second alignment electrode) connected to the second power line PL2, and a plurality of light emitting elements LD connected in parallel between the first and third electrodes EU and EL3 in the same direction. In an embodiment of the present disclosure, the first electrode EL1 may be an anode electrode and the third electrode EL3 may be a cathode electrode.

Each of the light emitting elements LD included in the light emitting unit EMU may include one end connected to the first power line PL1 through the first electrode EL1, and the other end connected to the second power line PL2 through the third electrode EL3.

The respective light emitting elements LD connected in parallel in the same direction between the first electrode EL1 and the third electrode EL3, to which voltages of different potentials (i.e., the first power supply voltage VDD and the second power supply voltage VSS) are respectively supplied, may constitute the respective effective light sources. These effective light sources may be gathered to constitute the light emitting unit EMU of the pixel PXL.

The light emitting elements LD of the light emitting unit EMU may emit light with a luminance corresponding to the driving current supplied through the pixel circuit PXC. For example, during each frame period, the pixel circuit PXC may supply, to the light emitting unit EMU, the driving current corresponding to the grayscale value of the frame data (e.g., the compensated data DATA3, see FIG. 1). The driving current supplied to the light emitting unit EMU may be divided and flowed through the light emitting elements LD. Therefore, while each of the light emitting elements LD emits light with a luminance corresponding to the current flowing therethrough, the light emitting unit EMU may emit light of a luminance corresponding to the driving current.

The light emitting unit EMU may further include at least one non-effective light source, for example, a reverse light emitting element LDr, in addition to the light emitting elements LD constituting the effective light sources. The reverse light emitting element LDr may be connected in parallel between the first and third electrodes EL1 and EL3 together with the light emitting elements LD constituting the effective light sources, and may be connected between the first and third electrodes EL1 and EL3 in a direction opposite to the light emitting elements LD (or a different polarity direction). The reverse light emitting element LDr maintains a deactivated state even when a driving voltage (e.g., a set or predetermined driving voltage) (e.g., a forward driving voltage) is applied between the first and third electrodes EL1 and EL3. Therefore, no current substantially flows through the reverse light emitting element LDr.

The pixel circuit PXC of the pixel PXL may be connected to a scan line SLi, a sensing scan line SSLi, a data line DLj, and a sensing line RLj. In this case, each of i and j may be a positive integer. As an example, when it is assumed that the pixel PXL is disposed in an i-th row and a j-th column of the display unit 110 (see FIG. 1), the pixel circuit PXC of the pixel PXL may be connected to an i-th scan line SLi, an i-th sensing scan line SSLi, a j-th data line DLj, and a j-th sensing line RLj.

According to an embodiment, the pixel circuit PXC may include first, second, and third transistors T1, T2, and T3 and a storage capacitor Cst. However, the structure of the pixel circuit PXC is not limited to the embodiment illustrated in FIG. 2.

A first terminal (or a first electrode) of the first transistor (e.g., a driving transistor) T1 may be connected to the first power line PL1, and a second terminal (or a second electrode) of the first transistor (e.g., the driving transistor) T1 may be connected to a second node N2 (or a first electrode EL1 of the light emitting unit EMU). In this case, the first terminal and the second terminal of the first transistor T1 may be different terminals. For example, when the first terminal is a drain electrode, the second terminal may be a source electrode. A gate electrode of the first transistor T1 may be connected to the first node N1. The first transistor T1 may control the amount of the driving current supplied to the light emitting elements LD in response to the voltage of the first node N1.

A first terminal of the second transistor (e.g., a switching transistor) T2 may be connected to the data line DLj, and a second terminal of the second transistor (e.g., the switching transistor) T2 may be connected to the first node N1. A gate electrode of the second transistor T2 may be connected to the scan line SLi. When the second transistor T2 is turned on by a scan signal SC of a gate-on voltage (e.g., a high voltage) at which the second transistor T2 can be turned on is supplied from the scan line SLi, the second transistor T2 may electrically connect the data line DLj to the first node N1. At this time, a data signal Vdata of a corresponding frame may be supplied to the data line DLj, and thus, the data signal Vdata may be transmitted to the first node N1. The data signal Vdata transmitted to the first node N1 may be charged in the storage capacitor Cst. For example, the storage capacitor Cst connected between the first node N1 and the second node N2 may be charged to a voltage or hold a charge corresponding to data signal Vdata transmitted to the first node N1.

One electrode of the storage capacitor Cst may be connected to the first node N1, and the other electrode of the storage capacitor Cst may be connected to the second node N2. The storage capacitor Cst may be charged with a voltage corresponding to the data signal Vdata supplied to the first node N1, and may maintain the charged voltage until a data signal Vdata of a next frame is supplied.

A first terminal of the third transistor (e.g., a sensing transistor) T3 may be connected to the second node N2, and a second terminal of the third transistor (e.g., the sensing transistor) T3 may be connected to the sensing line RLj. A gate electrode of the third transistor T3 may be connected to the sensing scan line SSLi. In some embodiments, when the sensing line RLj is not used (e.g., omitted), the second terminal of the third transistor T3 may be connected to the data line DLj. In some embodiments, when the sensing scan line SSLi is not used (e.g., omitted), the gate electrode of the third transistor T3 may be connected to the scan line SLi. The third transistor T3 may be turned on by a sensing scan signal SS of a gate-on voltage (e.g., a high level voltage) supplied to the sensing scan line SSLi during a sensing period (e.g., a set or predetermined sensing period), and may electrically connect the sensing line RLj to the second node N2.

According to an embodiment, the sensing period may be a period during which characteristic information of each of the pixels PXL (e.g., the threshold voltage of the first transistor T1) is extracted. During the above-described sensing period, a reference voltage (e.g., a set or predetermined reference voltage) at which the first transistor T1 can be turned on may be supplied to the first node N1 through the data line DLj and the second transistor T2, or the first transistor T1 may be turned on by connecting each pixel PXL to a current source or the like. In some embodiments, the third transistor T3 may be turned on by supplying the sensing scan signal SS of the gate-on voltage to the third transistor T3 to connect the first transistor T1 to the sensing line RLj. Therefore, characteristic information of each pixel PXL, including the threshold voltage of the first transistor T1, may be extracted through the above-described sensing line RLj. The extracted characteristic information may be used to convert image data so that characteristic deviation between the pixels PXL is compensated.

An embodiment in which the first, second, and third transistors T1, T2, and T3 are all N-type transistors is disclosed in FIG. 2, but the present disclosure is not limited thereto. For example, at least one of the first, second, and third transistors T1, T2, and T3 described above may be changed to a P-type transistor. An embodiment in which the light emitting unit EMU is connected between the pixel circuit PXC and the second power line PL2 is disclosed in FIG. 2, but the light emitting unit EMU may be connected between the first power line PL1 and the pixel circuit PXC.

The light emitting unit EMU may include a first stage SET1 (e.g., a first stack, a first sub light emitting unit, etc.) and a second stage SET2 (e.g., a second stack, a second sub light emitting unit, etc.), which are sequentially connected between the first and second power lines PL1 and PL2. The light emitting unit EMU may include first, second, third, and fourth electrodes EL1, EL2, EL3, and EL4, and each of the first and second stages SET1 and SET2 may include a plurality of light emitting elements LD connected in parallel between two electrodes from among the first, second, third, and fourth electrodes EL1, EL2, EL3, and EL4 in the same direction.

The first stage SET1 may include a first electrode EL1 and a second electrode EL2 (or a first sub center electrode CTE-1), and may include at least one first light emitting element LD1 connected between the first electrode EL1 and the second electrode EL2 (or the first sub center electrode CTE-1). In some embodiments, the first stage SET1 may include a reverse light emitting element LDr connected between the first electrode EL1 and the second electrode EL2 (or the first sub center electrode CTE-1) in a direction opposite to the first light emitting element LD1.

The second stage SET2 may include a fourth electrode EL4 (or a second sub center electrode CTE-2) and a third electrode EL3, and may include at least one second light emitting element LD2 connected between the fourth electrode EL4 (or the second sub center electrode CTE-2) and the third electrode EL3. In some embodiments, the second stage SET2 may include a reverse light emitting element LDr connected between the fourth electrode EL4 (or the second sub center electrode CTE-2) and the third electrode EL3 in a direction opposite to the second light emitting element LD2.

The first sub center electrode CTE-1 of the first stage SET1 and the second sub center electrode CTE-2 of the second stage SET2 may be integrally provided and connected to each other. That is, the first sub center electrode CTE-1 and the second sub center electrode CTE-2 may constitute a center electrode CTE for electrically connecting the first stage SET1 and the second stage SET2 which are continuous (e.g., connected in series with each other). When the first sub center electrode CTE-1 and the second sub center electrode CTE-2 are integrally provided, the first sub center electrode CTE-1 and the second sub center electrode CTE-2 may be different areas of the center electrode CTE.

In the above-described embodiment, the first electrode EL1 may be an anode electrode of the light emitting unit EMU of each pixel PXL, and the third electrode EL3 may be a cathode electrode of the light emitting unit EMU of each pixel PXL.

As described above, the light emitting unit EMU of the pixel PXL including the light emitting elements LD connected in the series/parallel hybrid structure may easily adjust the driving current/voltage condition according to the applied product specification.

For example, the light emitting unit EMU of the pixel PXL including the light emitting elements LD connected in the series/parallel hybrid structure may reduce the driving current compared to the light emitting unit EMU having a structure in which the light emitting elements LD are connected only in parallel.

As described above with reference to FIG. 2, the pixel PXL may include stages connected in series (e.g., the first and second stages SET1 and SET2) as the light emitting unit EMU. In this manner, the driving current of the pixel PXL may be reduced.

Although FIG. 2 illustrates that the pixel PXL (or the light emitting unit EMU) includes two stages (i.e., the first and second stages SET1 and SET2), the present disclosure is limited thereto. For example, the pixel PXL may include three or more stages, which will be described below with reference to FIG. 9.

Figure 3:
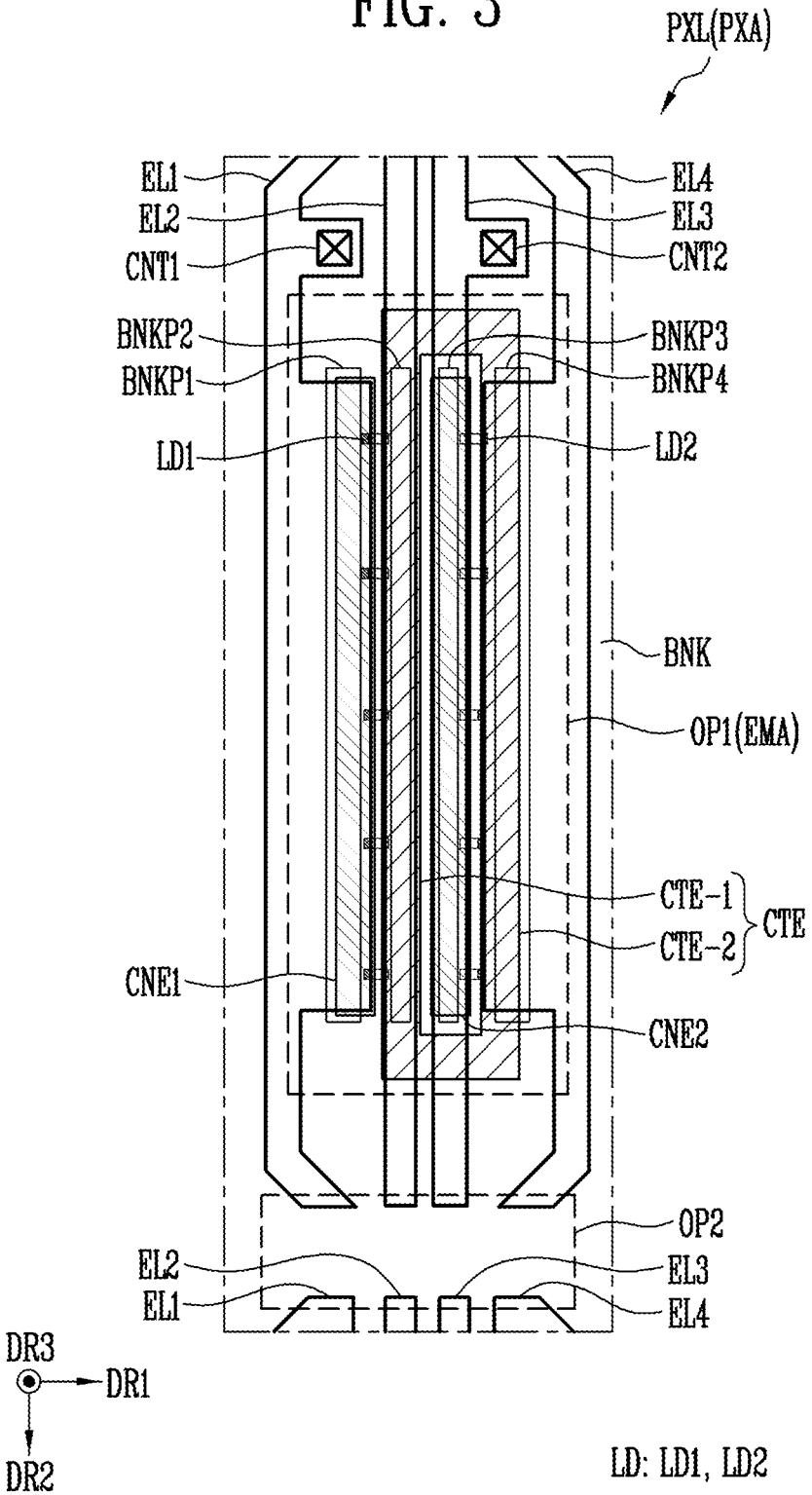
FIG. 3 is a plan view illustrating an example of the pixel of FIG. 2.

FIG. 3 is a plan view illustrating an example of the pixel of FIG. 2. In FIG. 3, the illustration of the transistors connected to the light emitting elements LD and the signal lines connected to the transistors is omitted for convenience, and the pixel PXL is schematically illustrated focusing on the light emitting unit EMU described above with reference to FIG. 2.

Referring to FIGS. 2 and 3, the pixel PXL may be formed in a pixel area PXA on a substrate. The pixel area PXA may include an emission area EMA. According to an embodiment, the pixel PXL may include a bank BNK and the emission area EMA may be surrounded and defined by the bank BNK. As illustrated in FIG. 3, the bank BNK may include a first opening OP1 and a second opening OP2 exposing a lower structure, and the emission area EMA may be defined by the first opening OP1 of the bank BNK. The second opening OP2 may be located spaced from the first opening OP1 in the pixel area PXA, and may be located adjacent to one side (e.g., the lower side or the upper side) of the pixel area PXA.

The pixel PXL may include a first electrode EL1, a second electrode EL2, a third electrode EL3, and a fourth electrode EL4, which are physically separated or spaced from each other along a first direction DR1. The first electrode EL1, the second electrode EL2, the third electrode EL3, and the fourth electrode EL4 may correspond to the first electrode EL1, the second electrode EL2, the third electrode EL3, and the fourth electrode EL4 described above with reference to FIG. 2, respectively.

The first electrode EL1, the second electrode EL2, the third electrode EL3, and the fourth electrode EL4 may be sequentially arranged along the first direction DR1. Each of the first electrode EL1, the second electrode EL2, the third electrode EL3, and the fourth electrode EL4 may extend in a second direction DR2 crossing the first direction DR1. Ends of the first electrode EL1, the second electrode EL2, the third electrode EL3, and the fourth electrode EL4 may be located in the second opening OP2 of the bank BNK. For reference, the first electrode EL1, the second electrode EL2, the third electrode EL3, and the fourth electrode EL4 may extend to the adjacent pixel areas before the light emitting elements LD are supplied on the substrate during the process of manufacturing the display device, and may be separated from other electrodes (e.g., electrodes of the pixels adjacent in the second direction DR2) at the second opening OP2 after the light emitting elements LD are supplied and disposed in the pixel area PXA. That is, the second opening OP2 of the bank BNK may be provided for the process of separating the first electrode EL1, the second electrode EL2, the third electrode EL3, and the fourth electrode EL4.

The first electrode EL1 may include a protrusion protruding in the emission area EMA toward the second electrode EL2 in the first direction DR1. The protrusion of the first electrode EL1 may be provided for maintaining a distance between the first electrode EL1 and the second electrode EL2 in the emission area EMA at an interval (e.g., a set or predetermined interval). Similarly, the fourth electrode EL4 may include a protrusion protruding in the emission area EMA toward the third electrode EL3 in a direction opposite to the first direction DR1. The protrusion of the fourth electrode EL4 may be provided for maintaining a distance between the third electrode EL3 and the fourth electrode EL4 in the emission area EMA at an interval (e.g., a set or predetermined interval).

However, the first electrode EL1, the second electrode EL2, the third electrode EL3, and the fourth electrode EL4 are not limited thereto. For example, the shape and/or mutual arrangement relationship of the first electrode EL1, the second electrode EL2, the third electrode EL3, and the fourth electrode EL4 may be variously changed. For example, each of the first electrode EL1 and the fourth electrode EL4 may not include a protrusion and may have a curved shape.

The first electrode EL1 may be connected through a first contact hole CNT1 to the first transistor T1 described above with reference to FIG. 2, and the third electrode EL3 may be connected through a second contact hole CNT2 to the second power line PL2 described above with reference to FIG. 2.

According to an embodiment, each of the first electrode EL1, the second electrode EL2, the third electrode EL3, and the fourth electrode EL4 may have a single layer structure or a multilayer structure. For example, the first electrode EL1, the second electrode EL2, the third electrode EL3, and the fourth electrode EL4 may have a multilayer structure including a reflective electrode and a conductive capping layer. In some embodiments, the reflective electrode may have a single layer structure or a multilayer structure. As an example, the reflective electrode may include at least one reflective conductive layer and may optionally further include at least one transparent conductive layer disposed above and/or below the reflective conductive layer.

According to an embodiment, the pixel PXL may include a first bank pattern BNKP1 overlapping a region of the first electrode EL1, a second bank pattern BNKP2 overlapping a region of the second electrode EL2, a third bank pattern BNKP3 overlapping a region of the third electrode EL3, and a fourth bank pattern BNKP4 overlapping a region of the fourth electrode EL4.

The first bank pattern BNKP1, the second bank pattern BNKP2, the third bank pattern BNKP3, and the fourth bank pattern BNKP4 may be spaced from each other in the first direction DR1 in the emission area EMA, and the region of each of the first electrode EL1, the second electrode EL2, the third electrode EL3, and the fourth electrode EL4 may protrude upward. For example, the first electrode EL1 (or the protrusion of the first electrode EL1) may be disposed on the first bank pattern BNKP1 and may protrude in a third direction DR3 (i.e., a thickness direction of the substrate SUB) by the first bank pattern BNKP1, the second electrode EL2 may be disposed on the second bank pattern BNKP2 and may protrude in the third direction DR3 by the second bank pattern BNKP2, the third electrode EL3 may be disposed on the third bank pattern BNKP3 and may protrude in the third direction DR3 by the third bank pattern BNKP3, and the fourth electrode EL4 (or the protrusion of the fourth electrode EL4) may be disposed on the fourth bank pattern BNKP4 and may protrude in the third direction DR3 by the fourth bank pattern BNKP4.

The pixel PXL may include the first light emitting element LD1 and the second light emitting element LD2. In some embodiments, the pixel PXL may further include the reverse light emitting element LDr described above with reference to FIG. 2.

The first light emitting element LD1 may be disposed between the first electrode EL1 and the second electrode EL2. A first end (or one end) of the first light emitting element LD1 may face the first electrode EL1, and a second end (or the other end) of the first light emitting element LD1 may face the second electrode EL2. When a plurality of first light emitting elements LD1 are provided, the first light emitting elements LD1 may be connected in parallel between the first electrode EL1 and the second electrode EL2, and may constitute the first stage SET1 described above with reference to FIG. 2.

Similarly, the second light emitting element LD2 may be disposed between the third electrode EL3 and the fourth electrode EL4. A first end of the second light emitting element LD2 may face the fourth electrode EL4, and a second end of the second light emitting element LD2 may face the third electrode EL3. The second end of the second light emitting element LD2 and the second end of the first light emitting element LD1 may include the same type of semiconductor layers (e.g., p-type semiconductor layers), and may face each other with the second electrode EL2 and the third electrode EL3 disposed therebetween. When a plurality of second light emitting elements LD2 are provided, the second light emitting elements LD2 may be connected in parallel between the third electrode EL3 and the fourth electrode EL4, and may constitute the second stage SET2 described above with reference to FIG. 2.

Although FIG. 3 illustrates that the light emitting elements LD are aligned in the first direction DR1 between the first electrode EL1 and the second electrode EL2 and between the third electrode EL3 and the fourth electrode EL4, the alignment direction of the light emitting elements LD is not limited thereto. For example, at least one of the light emitting elements LD may be disposed in a diagonal direction.

In an example embodiment, the first end of the first light emitting element LD1 is not directly disposed on the first electrode EL1, but may be electrically connected to the first electrode EL1 through at least one contact electrode, for example, the first contact electrode CNE1. Similarly, the second end of the second light emitting element LD2 is not directly disposed on the third electrode EL3, but may be electrically connected to the third electrode EL3 through at least one contact electrode, for example, the second contact electrode CNE2. However, the present disclosure is not limited thereto. For example, the first end of the first light emitting element LD1 may be in direct contact with the first electrode EL1 and may be electrically connected to the first electrode EL1.

According to an embodiment, each of the first light emitting element LD1 and the second light emitting element LD2 may be a light emitting diode having an ultra-small size (e.g., a size as small as nanoscale to microscale) using a material having an inorganic crystal structure. A detailed structure of the light emitting element LD will be described in detail with reference to FIGS. 15 and 16.

According to an embodiment, the light emitting elements LD may be prepared in a form to be dispersed in a solution (e.g., a set or predetermined solution) and may be supplied to the emission area EMA of the pixel area PXA through inkjet printing or slit coating. For example, the light emitting elements LD may be mixed with a volatile solvent and supplied to the emission area EMA. At this time, when a voltage (e.g., a set or predetermined voltage) is applied between the first electrode EL1 and the second electrode EL2 and between the third electrode EL3 and the fourth electrode EL4, an electric field is formed between the first electrode EL1 and the second electrode EL2 and between the third electrode EL3 and the fourth electrode EL4, and the light emitting elements LD are self-aligned between the first electrode EL1, the second electrode EL2, the third electrode EL3, and the fourth electrode EL4. After the light emitting elements LD are aligned, the solvent is volatilized or removed in any other way. Thus, the light emitting elements LD may be stably disposed between the first electrode EL1 and the second electrode EL2 and between the third electrode EL3 and the fourth electrode EL4.

According to some embodiments, the pixel PXL may include the first contact electrode CNE1, the second contact electrode CNE2, and the center electrode CTE.

The first contact electrode CNE1 may be formed on the first end of the first light emitting element LD1 and at least one region of the first electrode EL1 corresponding thereto, and may physically and/or electrically connect the first end of the first light emitting element LD1 to the first electrode EL1.

The second contact electrode CNE2 may be formed on the second end of the second light emitting element LD2 and at least one region of the third electrode EL3 corresponding thereto, and may physically and/or electrically connect the second end of the second light emitting element LD2 to the third electrode EL3.

The center electrode CTE may include a first sub center electrode CTE-1 (or a first center electrode) and a second sub center electrode CTE-2 (or a second center electrode) extending in the second direction DR2. The first sub center electrode CTE-1 may be formed on the second end of the first light emitting element LD1 and at least one region of the second electrode EL2 corresponding thereto. The center electrode CTE may extend from the first sub center electrode CTE-1 to bypass the second contact electrode CNE2 or the second light emitting element LD2, and the second sub center electrode CTE-2 may be formed on the first end of the second light emitting element LD2 and at least one region of the fourth electrode EL4 corresponding thereto. The center electrode CTE may electrically connect the second end of the first light emitting element LD1 to the first end of the second light emitting element LD2.

As illustrated in FIG. 3, the center electrode CTE may be spaced from the second contact electrode CNE2 and may have a closed loop shape surrounding the second contact electrode CNE2. Therefore, the second light emitting element LD2 may be connected in series to the first light emitting element LD1 through the center electrode CTE.

As described above with reference to FIG. 3, the first and second light emitting elements LD1 and LD2 may be disposed between the first to fourth electrodes EL1, EL2, EL3, and EL4, and the first light emitting element LD1 and the second light emitting element LD2 may be connected in series through the center electrode CTE. In this manner, the light emitting unit EMU of the pixel PXL may be configured by connecting the first and second light emitting elements LD1 and LD2 disposed in the pixel area PXA of the pixel PXL in a series structure.

Figure 4:
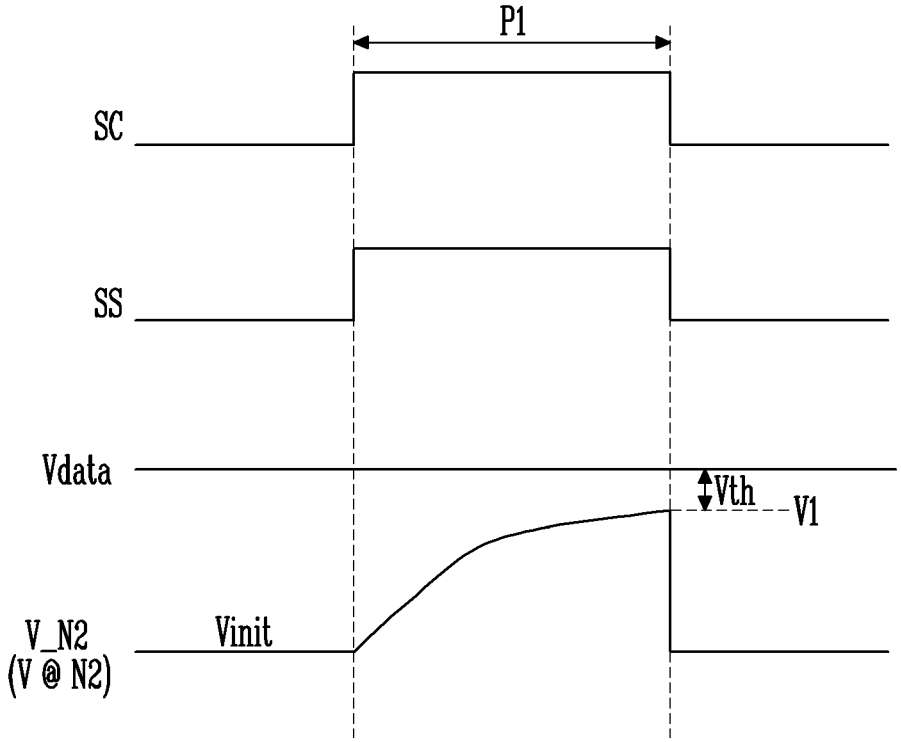
FIG. 4 is a waveform diagram illustrating an example of signals measured in the pixel of FIG. 2.

FIG. 4 is a waveform diagram illustrating an example of signals measured in the pixel of FIG. 2. Signals for explaining the operation of the pixel PXL in the sensing mode are illustrated in FIG. 4. In the sensing mode, characteristics of the pixel PXL (e.g., the threshold voltage of the first transistor T1) may be sensed.

Referring to FIGS. 1, 2, and 4, in a first period P1, the scan signal SC applied to the scan line SLi may have a pulse of a gate-on voltage level.

In this case, in the first period P1, the second transistor T2 may be turned on in response to the scan signal SC of the gate-on voltage level, and the data line DLj may be connected to the first node N1.

When the data signal Vdata (or the reference voltage) is applied to the data line DLj, the data signal Vdata may be applied to the first node N1. In this case, the data signal Vdata may have a voltage level for sensing the threshold voltage Vth of the first transistor T1. In an embodiment, the data signal Vdata may have a voltage level lower than the total operating voltage of the first stage SET1 (or the first light emitting element LD1) and the second stage SET2 (or the second light emitting element LD2). In this case, the operating voltage is a voltage required for the light emitting element LD to emit light. The operating voltage may be, for example, the threshold voltage of the light emitting element LD. In some embodiments, the data signal Vdata may have a voltage level higher than the operating voltage of each of the first stage SET1 (or the first light emitting element LD1) and the second stage SET2 (or the second light emitting element LD2). For example, when the operating voltage of each of the first light emitting element LD1 and the second light emitting element LD2 is 2.5V, the data signal Vdata may have a voltage level of 4 V lower than 5 V (=2.5 V*2) based on the second power supply voltage VSS. However, the present disclosure is not limited thereto. For example, the data signal Vdata may have a voltage level substantially equal to or similar to the total operating voltage of the first stage SET1 (or the first light emitting element LD1) and the second stage SET2 (or the second light emitting element LD2).

Similar to the scan signal SC, in the first period P1, the sensing scan signal SS applied to the sensing scan line SSLi may have a pulse of a gate-on voltage level. The waveform and phase of the sensing scan signal SS may be substantially identical to the waveform and phase of the scan signal SC.

In this case, in the first period P1, the third transistor T3 may be turned on in response to the sensing scan signal SS of the gate-on voltage level, and the sensing line RLj may be connected to the second node N2.

When an initialization voltage Vinit is applied from the sensing driver 140 to the sensing line RLj at the start of the first period P1, the initialization voltage Vinit may be applied to the second node N2. Therefore, a node voltage V_N2 of the second node N2 at the start of the first period P1 may have a voltage level of the initialization voltage Vinit. For example, the initialization voltage Vinit may have a voltage level of 2 V.

Thereafter, the sensing driver 140 may cut off the supply of the initialization voltage Vinit until the end of the first period P1.

In this case, the first transistor T1 supplies the current corresponding to a gate-source voltage to the second node N2. Therefore, the node voltage V_N2 of the second node N2 may linearly increase to a specific voltage level (e.g., a first voltage level V1). For example, the node voltage V_N2 of the second node N2 may increase to the first voltage level V1 corresponding to a difference between the data signal Vdata and the threshold voltage Vth of the first transistor T1 (i.e., V1=Vdata−Vth).

Therefore, the sensing driver 140 may sense the threshold voltage Vth of the first transistor T1 (or the node voltage V_N2).

In some embodiments, when the first voltage level V1 (or the sensing voltage) measured in the first period P1 is within the reference range, the sensing driver 140 may set the stack number information of the pixel PXL to have a maximum value. In this case, the reference range may be less than the product of the total number of stages SET1 and SET2 and the operating voltage of the light emitting element LD and greater than the product of the number of stages SET1 and SET2 excluding one stage (i.e., the total number−1) and the operating voltage of the light emitting element LD. For example, when two stages SET1 and SET2 are present and the operating voltage of the light emitting element LD is 2.5 V, the reference range may be less than 5 V and greater than 2.5 V. When the first voltage level V1 is about 3 V, the first voltage level V1 is within the reference range, and thus, the sensing driver 140 may set the stack number information of the pixel PXL to 2, which is the maximum value (i.e., the total number of stages SET1 and SET2).

A case in which the stack number information is set to a value different from the maximum value (i.e., a value smaller than the maximum value) will be described with reference to FIGS. 5 and 6.

Figure 5:
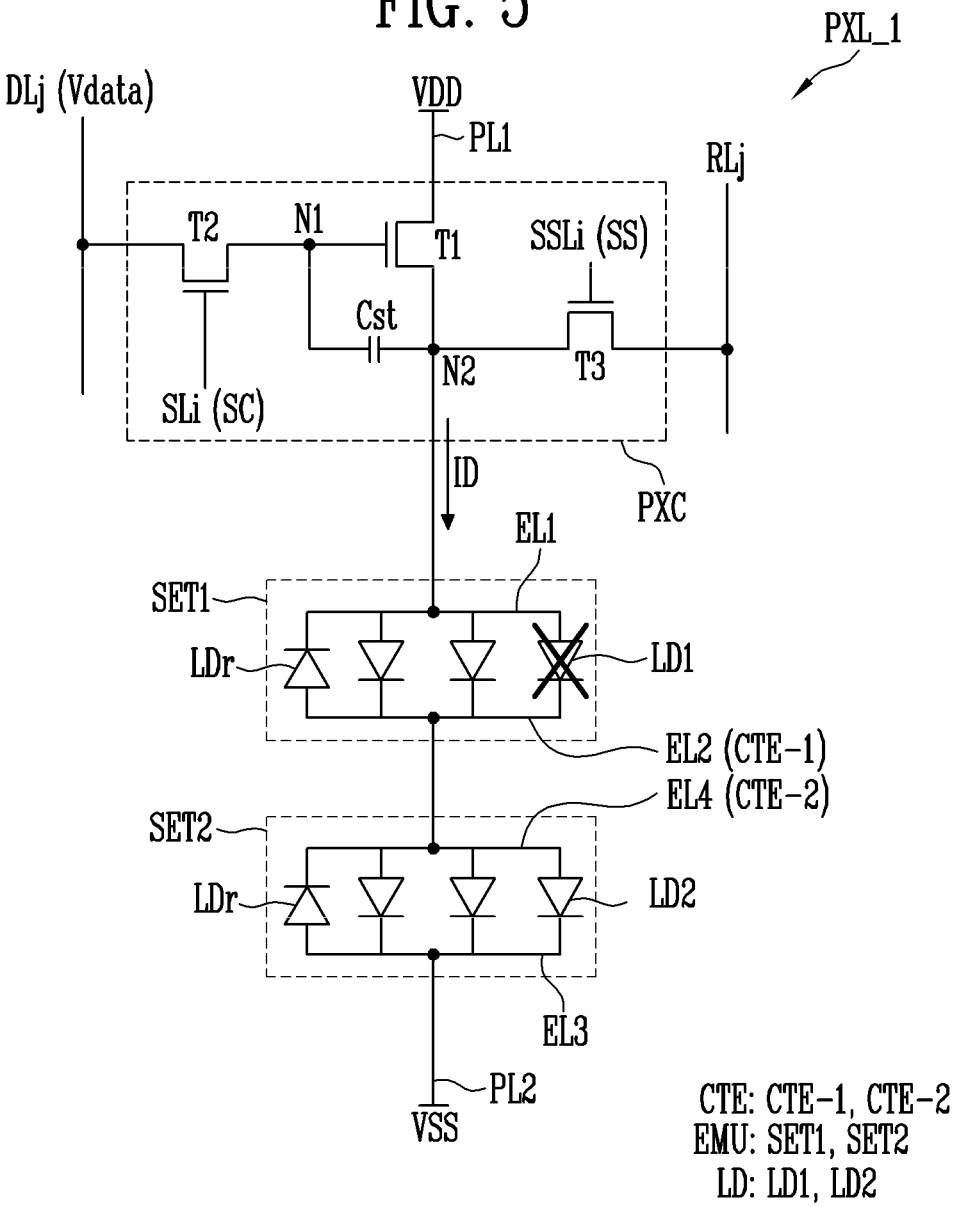
FIG. 5 is a circuit diagram illustrating an example of the pixel included in the display device of FIG. 1.

FIG. 5 is a circuit diagram illustrating an example of the pixel included in the display device of FIG. 1. FIG. 5 illustrates a circuit diagram corresponding to FIG. 2. FIG. 6 is a waveform diagram illustrating an example of signals measured in the pixel of FIG. 5. FIG. 6 illustrates a waveform diagram corresponding to FIG. 4.

First, referring to FIGS. 2 and 5, the pixel PXL_1 of FIG. 5 may be substantially identical to or similar to the pixel PXL of FIG. 2, except that the first light emitting element LD1 is defective. Therefore, redundant descriptions thereof will not be repeated. The defect of the first light emitting element LD1 is an example, and for example, the defect may occur in the second light emitting element LD2 instead of the first light emitting element LD1.

For example, the first electrode EL1 and the second electrode EL2 may be short-circuited by the first light emitting element LD1 having the defect illustrated in FIG. 5. In this case, the driving current flowing between the first electrode EL1 and the second electrode EL2 may flow through the first light emitting element LD1 having the defect (i.e., short-circuit), and the driving current may not flow through the other first light emitting elements LD1 that require the operating voltage.

For reference, when the first light emitting element LD1 is opened, the driving current may not flow only to the corresponding first light emitting element LD1, and the driving current may flow through the other first light emitting elements LD1. Therefore, display quality may hardly be deteriorated. As the number of first light emitting elements LD1 increases, the opening of one first light emitting element LD1 may have little influence on the first stage SET1. In contrast, when the first light emitting element LD1 is short-circuited, the first stage SET1 does not operate (or not emit light), and the luminance of the pixel PXL 1 may be greatly reduced (e.g., at a level of ½). When the same data signal Vdata is applied to the pixel PXL of FIG. 2 and the pixel PXL_1 of FIG. 5, the pixel PXL_1 of FIG. 5 may emit light with a lower luminance than that of the pixel PXL of FIG. 2. When the display unit 110 (see FIG. 1) includes a plurality of pixels PXL_1 (i.e., defective pixels PXL_1) of FIG. 5, luminance deviation may occur and display quality may deteriorate.

Therefore, the defective pixel PXL_1 is detected, and the defective pixel PXL_1 and the other pixels PXL (see FIG. 2) emit light with the same luminance, thereby preventing deterioration in display quality.

In some embodiments, an optical imaging method of measuring the luminance of the specific region of the display unit 110 (see FIG. 1) or a method of sensing the current flowing through the display unit 110 (or the pixel PXL_1) has difficulty in accurately determining whether the defect has occurred in each pixel PXL_1 or detecting the defective pixel PXL_1. Therefore, the display device 100 according to the embodiments of the present disclosure may detect whether the defect (e.g., a short-circuit having great influence on the luminance change) has occurred in the pixel PXL_1, based on the sensed threshold voltage Vth of the first transistor T1 (or the driving transistor).

Figures 6, 7:
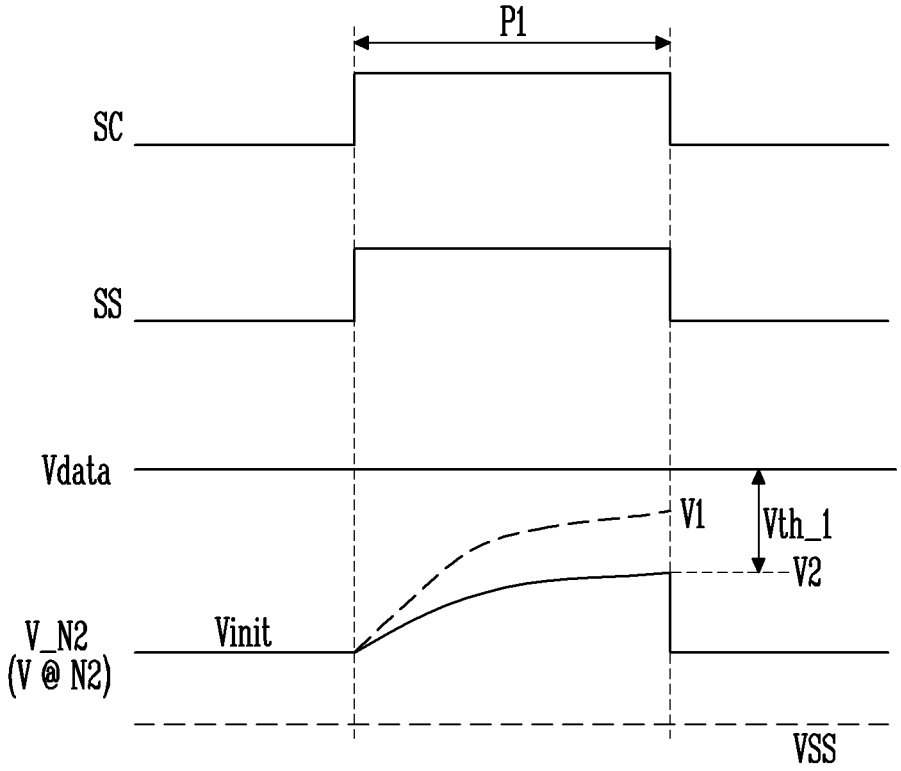
FIG. 6 is a waveform diagram illustrating an example of signals measured in the pixel of FIG. 5.
FIG. 7 is a diagram illustrating an example of a lookup table including stack number information used in the display device of FIG. 1.

Referring to FIGS. 4, 5, and 6, a scan signal SC, a sensing scan signal SS, and a data signal Vdata illustrated in FIG. 6 may be substantially identical to or similar to the scan signal SC, the sensing scan signal SS, and the data signal Vdata described above with reference to FIG. 4, respectively. Therefore, redundant descriptions thereof will not be repeated.

The initialization voltage Vinit is applied from the sensing driver 140 to the sensing line RLj at the start of the first period P1, and the supply of the initialization voltage Vinit may be cut off until the end of the first period P1.

In this case, the first transistor T1 supplies a current corresponding to a gate-source voltage to the second node N2. Therefore, the node voltage V_N2 of the second node N2 may increase linearly. However, when the defect occurs in the first light emitting element LD1, the node voltage V_N2 of the second node N2 may increase only to the second voltage level V2 lower than the first voltage level V1. This is because, as the first electrode EL1 and the second electrode EL2 illustrated in FIG. 5 are short-circuited, the current flows or leaks through the second light emitting element LD2 when the node voltage V_N2 of the second node N2 becomes higher than the operating voltage of the second light emitting element LD2 (or the second stage SET2) based on the second power supply voltage VSS. Therefore, the second voltage level V2 may be equal to or similar to the operating voltage of the second light emitting element LD2 based on the second power supply voltage VSS. For example, the second voltage level V2 may be about 2.5 V.

When the second voltage level V2 measured in the first period P1 is out of the reference range (i.e., the reference range described above with reference to FIG. 4), the sensing driver 140 may set the stack number information of the pixel PXL_1 to have a value smaller than the maximum value (e.g., "maximum value−1"). For example, when the second voltage level V2 is about 2.5 V and the reference range is greater than 2.5 V and less than 5 V, the second voltage level V2 is out of the reference range, and thus, the sensing driver 140 may set the stack number information of the pixel PXL_1 to 1.

For reference, when the defect occurs in both the first light emitting element LD1 and the second light emitting element LD2, the first electrode EL1, the second electrode EL2, the third electrode EL3, and the fourth electrode EL4 illustrated in FIG. 5 may be short-circuited, and the node voltage V_N2 of the second node N2 may be equal to the voltage level of the second power supply voltage VSS. Therefore, a complete defect, which is not a partial defect, that is, a non-operating pixel PXL_1 may be detected. Because the stack number information of the non-operating pixel PXL_1 (and data compensation based thereon) is meaningless, the stack number information of the non-operating pixel PXL_1 may be set arbitrarily (e.g., to 0). On the other hand, a repair operation may be performed on the non-operating pixel PXL_1.

A case in which the sensing driver 140 sets the stack number information of the pixel PXL_1 (or the pixel PXL) based on whether the second voltage level V2 (or the first voltage level V1) is within the reference range has been described, but the present disclosure is not limited thereto. For example, the sensing driver 140 may set the stack number information based on whether the threshold voltage Vth_1 of the first transistor T1 of the pixel PXL_1 is within a normal range.

As described above with reference to FIGS. 4-6, the display device 100 may determine whether the defect (e.g., the short-circuit that has great influence on the luminance change) has occurred in the pixel PXL or PXL_1, based on the sensed threshold voltage Vth or Vth_1 (or the sensed voltage level V1 or V2) of the first transistor T1 (or the driving transistor), and may set the stack number information of the pixel PXL or PXL_1.

FIG. 7 is a diagram illustrating an example of a lookup table including stack number information used in the display device of FIG. 1.

Referring to FIGS. 1, 2, and 7, a lookup table LUT may include the stack number information INFO_S of each of the pixels PXL.

The lookup table LUT may include first stack number information INFO_S1 of the first pixel PXL1 located in the first row and the first column, and second stack number information INFO_S2 of the second pixel PXL2 located in the first row and the second column.

When the value of the first stack number information INFO_S1 is 2, both of the two stages of the first pixel PXL1 may constitute the effective light source. The number of stages that do not contribute to constituting the effective light source may be 0, which is given in parentheses.

When the value of the second stack number information INFO_S2 is 1, only one of the two stages in the second pixel PXL2 may constitute the effective light source. The number of stages that do not contribute to constituting the effective light source may be 1.

In another embodiment, the stack number information INFO_S may indicate the number of some stages (e.g., defective stages) that do not contribute to constituting the effective light source among the stages of the pixel PXL.

Figure 8:
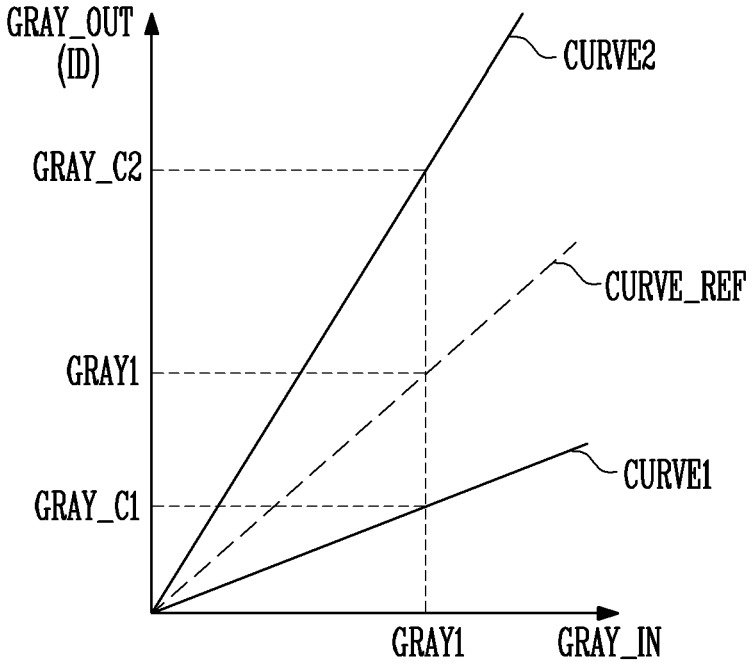
FIG. 8 is a diagram for describing an operation of a compensator included in the display device of FIG. 1.

FIG. 8 is a diagram for describing the operation of the compensator included in the display device of FIG. 1.

Referring to FIGS. 1, 7, and 8, a reference curve CURVE_REF (or a reference conversion line), a first curve CURVE1 (or a first conversion line), and a second curve CURVE2 (or a second conversion line) may each represent a relationship between an input grayscale GRAY_IN and an output grayscale GRAY_OUT (or a compensated grayscale). In this case, the input grayscale GRAY_IN may be included in the image data DATA2, and the output grayscale GRAY_OUT may be included in the compensated data DATA3.

The value of the input grayscale GRAY_IN and the value of the output grayscale GRAY_OUT on the reference curve CURVE_REF may be equal to each other. For example, a first grayscale value GRAY1 of the input grayscale GRAY_IN on the reference curve CURVE_REF may correspond to a first grayscale value GRAY1 of the output grayscale GRAY_OUT.

The value of the output grayscale GRAY_OUT on the first curve CURVE1 may be smaller than the value of the input grayscale GRAY_IN. For example, the first grayscale value GRAY1 of the input grayscale GRAY_IN on the first curve CURVE1 may correspond to the first compensated grayscale value GRAY_C1 of the output grayscale GRAY_OUT, and the first compensated grayscale value GRAY_C1 may be smaller than the first grayscale value GRAY1. For example, the first compensated grayscale value GRAY_C1 may be ½ times or ¾ times the first grayscale value GRAY1.

The value of the output grayscale GRAY_OUT on the second curve CURVE2 may be greater than the value of the input grayscale GRAY_IN. For example, the first grayscale value GRAY1 of the input grayscale GRAY_IN on the second curve CURVE2 may correspond to the second compensated grayscale value GRAY_C2 of the output grayscale GRAY_OUT, and the second compensated grayscale value GRAY_C2 may be greater than the first grayscale value GRAY1. For example, the second compensated grayscale value GRAY_C2 may be twice or 1.5 times the first grayscale value GRAY1.

In some embodiments, the compensator 160 may select one of the reference curve CURVE_REF, the first curve CURVE1, and the second curve CURVE2 based on the stack number information INFO_S, and may use the selected curve to compensate the input grayscale GRAY_IN and generate the output grayscale GRAY_OUT (or the compensated grayscale).

In an embodiment, when the first stack number information INFO_S1 of the first pixel PXL1 is greater than the second stack number information INFO_S2 of the second pixel PXL2, the compensator 160 may generate the first compensated grayscale value by downscaling the grayscale value of the first pixel PXL1 based on the grayscale value of the second pixel PXL2. For example, the compensator 160 may generate the first compensated grayscale value GRAY_C1 by compensating the first grayscale value GRAY1 of the first pixel PXL1 using the first curve CURVE1. On the other hand, the compensator 160 may compensate the grayscale value of the second pixel PXL2 using the reference curve CURVE_REF, or may not compensate the grayscale value of the second pixel PXL2.

In this case, the data signal Vdata (see FIG. 2) applied to the first pixel PXL1 in correspondence to the first compensated grayscale value GRAY_C1 may become less than the data signal Vdata applied to the second pixel PXL2 for the same luminance, and the driving current (or the amount of current) flowing through the first pixel PXL1 may become smaller than the driving current flowing through the second pixel PXL2.

In an embodiment, when the first stack number information INFO_S1 of the first pixel PXL1 is greater than the second stack number information INFO_S2 of the second pixel PXL2, the compensator 160 may generate the second compensated grayscale value by upscaling the grayscale value of the second pixel PXL2 based on the grayscale value of the first pixel PXL1. For example, the compensator 160 may generate the second compensated grayscale value GRAY_C2 by compensating the first grayscale value GRAY1 of the second pixel PXL2 using the second curve CURVE2. On the other hand, the compensator 160 may compensate the grayscale value of the first pixel PXL1 using the reference curve CURVE_REF, or may not compensate the grayscale value of the first pixel PXL1.

In this case, the data signal Vdata applied to the second pixel PXL2 in correspondence to the second compensated grayscale value GRAY_C2 may become greater than the data signal Vdata applied to the first pixel PXL1 for the same luminance, and the driving current (or the amount of current) flowing through the second pixel PXL2 may become larger than the driving current flowing through the first pixel PXL1.

In an embodiment, when the first stack number information INFO_S1 of the first pixel PXL1 is greater than the second stack number information INFO_S2 of the second pixel PXL2, the compensator 160 may generate the first compensated grayscale value by downscaling the grayscale value of the first pixel PXL1 and generate the second compensated grayscale value by upscaling the grayscale value of the second pixel PXL2. For example, the compensator 160 may generate the first compensated grayscale value GRAY_C1 by compensating the first grayscale value GRAY1 of the first pixel PXL1 using the first curve CURVE1 and generate the second compensated grayscale value GRAY_C2 by compensating the first grayscale value GRAY1 of the second pixel PXL2 using the second curve CURVE2.

As described above with reference to FIG. 8, the compensator 160 may decrease the grayscale value of the first pixel PXL1 corresponding to the relatively large first stack number information INFO_S1, or may increase the grayscale value of the second pixel PXL2 corresponding to the relatively small second stack number information INFO_S2. Therefore, the data signal Vdata applied to the first pixel PXL1 and the driving current corresponding thereto may decrease, or the data signal Vdata applied to the second pixel PXL2 and the driving current corresponding thereto may increase, and the difference in luminance between the first pixel PXL1 and the second pixel PXL2 may be improved.

Figure 9:
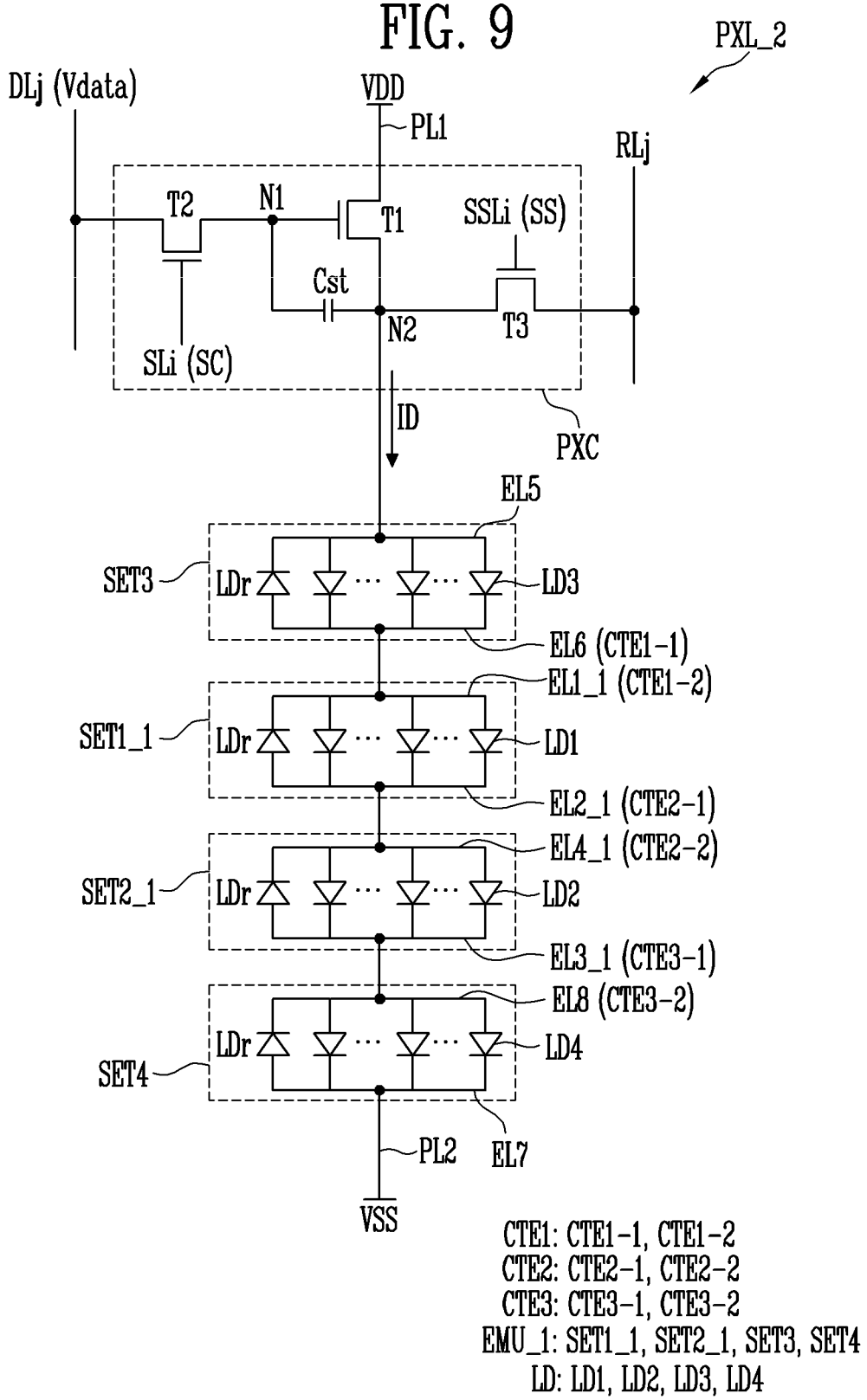
FIG. 9 is a circuit diagram illustrating an example of the pixel included in the display device of FIG. 1.

FIG. 9 is a circuit diagram illustrating an example of the pixel included in the display device of FIG. 1.

Referring to FIGS. 1, 2, and 9, a pixel PXL_2 includes a light emitting unit EMU_1 and a pixel circuit PXC. Because the pixel circuit PXC is substantially identical to the pixel circuit PXC described above with reference to FIG. 2, redundant descriptions thereof will not be repeated.

The light emitting unit EMU_1 may include a plurality of light emitting elements LD connected in series/parallel between a first power line PL1 to which a first power supply voltage VDD is applied and a second power line PL2 to which a second power supply voltage VSS is applied.

The light emitting unit EMU_1 may include a third stage SET3 (or a third sub light emitting unit), a first stage SET1_1 (or a first sub light emitting unit), a second stage SET2_1 (or a second sub light emitting unit), and a fourth stage SET4 (or a fourth sub light emitting unit), which are sequentially connected between the first and second power lines PL1 and PL2. The light emitting unit EMU_1 may include first to eighth electrodes EL1_1, EL2_1, EL3_1, EL4_1, EL5, EL6, EL7, and EL8, and each of the first to fourth stages SET1_1, SET2_1, SET3, and SET4 may include a plurality of light emitting elements LD connected in parallel between two of the first to eighth electrodes EL1_1, EL2_1, EL3_1, EL4_1, EL5, EL6, EL7, and EL8 in the same direction.

The first stage SET1_1 and the second stage SET2_1 may be substantially identical to or similar to the first stage SET1 and the second stage SET2 described above with reference to FIG. 2, respectively.

The first stage SET1_1 may include a first electrode EL1_1 (or a (1-2)-th center electrode CTE1-2) and a second electrode EL2_1 (or a (2-1)-th center electrode CTE2-1), and may include at least one first light emitting element LD1 connected between the first electrode EL1_1 (or the (1-2)-th center electrode CTE1-2) and the second electrode EL2_1 (or the (2-1)-th center electrode CTE2-1).

The second stage SET2_1 may include a fourth electrode EL4_1 (or a (2-2)-th center electrode CTE2-2) and a third electrode EL3_1 (or a (3-1)-th center electrode CTE3-1), and may include at least one second light emitting element LD2 connected between the fourth electrode EL4_1 (or the (2-2)-th center electrode CTE2-2) and the third electrode EL3_1 (or the (3-1)-th center electrode CTE3-1).

The third stage SET3 may include a fifth electrode EL5 and a sixth electrode EL6 (or a (1-1)-th center electrode CTE1-1), and may include at least one third light emitting element LD3 connected between the fifth electrode EL5 and the sixth electrode EL6 (or the (1-1)-th center electrode CTE1-1).

The fourth stage SET4 may include an eighth electrode EL8 (or a (3-2)-th center electrode CTE3-2) and a seventh electrode EL7, and may include at least one fourth light emitting element LD4 connected between the eighth electrode EL8 (or the (3-2)-th center electrode CTE3-2) and the seventh electrode EL7.

The (1-1)-th center electrode CTE1-1 of the third stage SET3 and the (1-2)-th center electrode CTE1-2 of the first stage SET1_1 may be integrally provided and connected to each other. That is, the (1-1)-th center electrode CTE1-1 and the (1-2)-th center electrode CTE1-2 may constitute a first center electrode CTE1 for electrically connecting the third stage SET3 and the first stage SET1_1 which are continuous. When the (1-1)-th center electrode CTE1-1 and the (1-2)-th center electrode CTE1-2 are integrally provided, the (1-1)-th center electrode CTE1-1 and the (1-2)-th center electrode CTE1-2 may be different regions of the first center electrode CTE1.

Similarly, the (2-1)-th center electrode CTE2-1 of the first stage SET1_1 and the (2-2)-th center electrode CTE2-2 of the second stage SET2_1 may be integrally provided and connected to each other. That is, the (2-1)-th center electrode CTE2-1 and the (2-2)-th center electrode CTE2-2 may constitute a second center electrode CTE2 for electrically connecting the first stage SET1_1 and the second stage SET2_1 which are continuous.

Similarly, the (3-1)-th center electrode CTE3-1 of the second stage SET2_1 and the (3-2)-th center electrode CTE3-2 of the fourth stage SET4 may be integrally provided and connected to each other. That is, the (3-1)-th center electrode CTE3-1 and the (3-2)-th center electrode CTE3-2 may constitute a third center electrode CTE3 for electrically connecting the second stage SET2_1 and the fourth stage SET4 which are continuous.

In the above-described embodiment, the fifth electrode EL5 may be an anode electrode of the light emitting unit EMU1_1 of the pixel PXL_2, and the seventh electrode EL7 may be a cathode electrode of the light emitting unit EMU_1 of the pixel PXL_2.

As described above, the light emitting unit EMU_1 of the pixel PXL_2 including the light emitting elements LD connected in a series/parallel hybrid structure may easily adjust the driving current/voltage condition according to the applied product specification.

Figure 10:
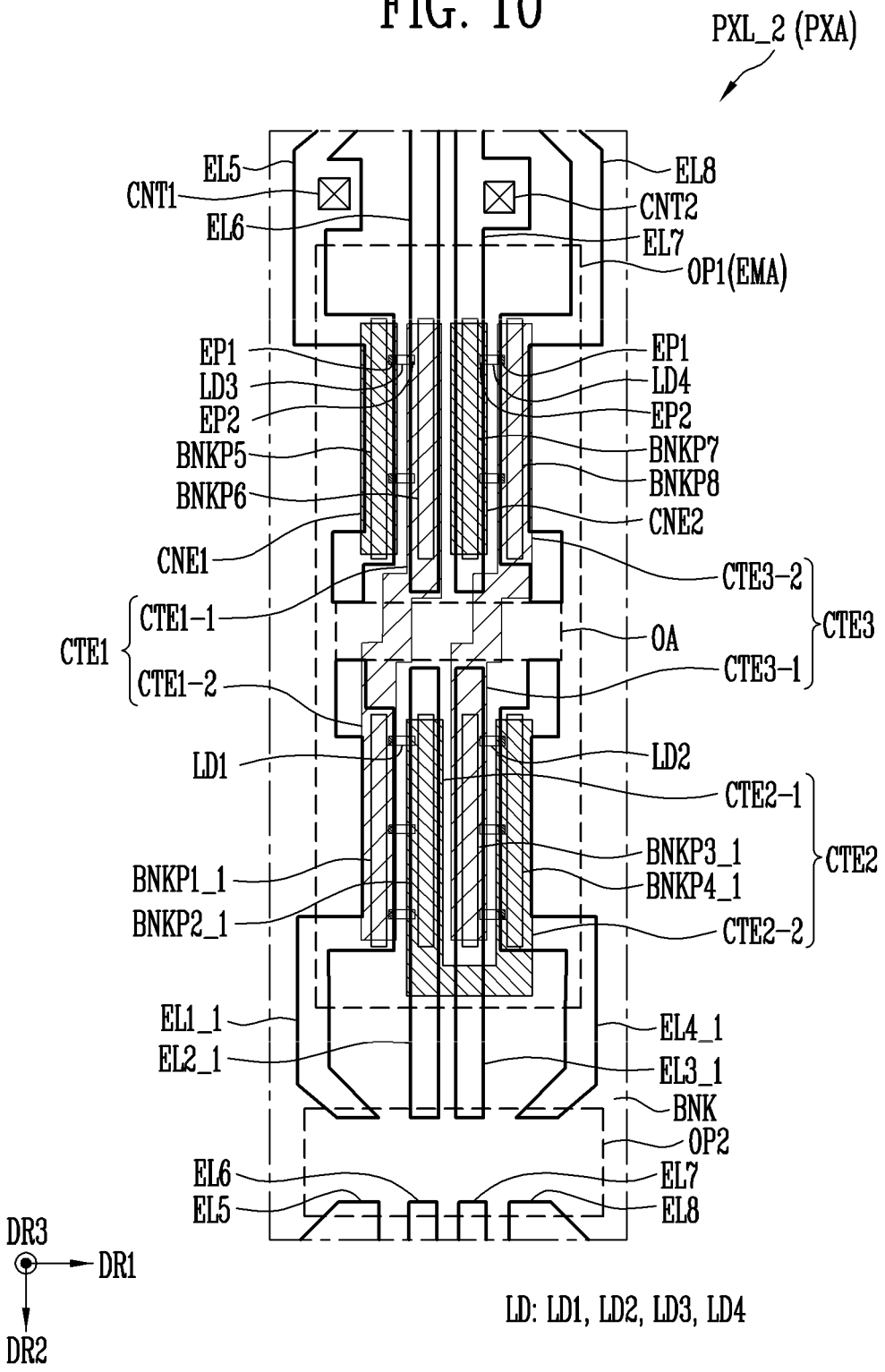
FIG. 10 is a plan view illustrating an example of the pixel of FIG. 9.

FIG. 10 is a plan view illustrating an example of the pixel of FIG. 9. In FIG. 10, the illustration of the transistors connected to the light emitting elements LD and the signal lines connected to the transistors is omitted for convenience, and the pixel PXL_2 is schematically illustrated focusing on the light emitting unit EMU_1 described above with reference to FIG. 9.

Referring to FIGS. 1, 3, 9, and 10, the pixel PXL_2 may be formed in a pixel area PXA on a substrate. The pixel area PXA may include an emission area EMA. According to an embodiment, the pixel PXL_2 may include a bank BNK and the emission area EMA may be surrounded and defined by the bank BNK. Because the bank BNK has been described above with reference to FIG. 3, redundant descriptions thereof will not be repeated.

The pixel PXL_2 may include a first electrode EL1_1, a second electrode EL2_1, a third electrode EL3_1, a fourth electrode EL4_1, a fifth electrode EL5, a sixth electrode EL6, a seventh electrode EL7, and an eighth electrode EL8, which are physically separated from each other or spaced from each other.

The first electrode EL1_1, the second electrode EL2_1, the third electrode EL3_1, and the fourth electrode EL4_1 may be sequentially disposed in (or arranged along) a first direction DR1. Each of the first electrode EL1_1, the second electrode EL2_1, the third electrode EL3_1, and the fourth electrode EL4_1 may extend in a second direction DR2 crossing the first direction DR1.

The fifth electrode EL5, the sixth electrode EL6, the seventh electrode EL7, and the eighth electrode EL8 may be spaced from the first electrode EL1_1, the second electrode EL2_1, the third electrode EL3_1, and the fourth electrode EL4_1 in the second direction DR2, respectively, and may be sequentially disposed in (or arranged along) the first direction DR1. Each of the fifth electrode EL5, the sixth electrode EL6, the seventh electrode EL7, and the eighth electrode EL8 may extend in the second direction DR2.

One end of each of the first electrode EL1_1, the second electrode EL2_1, the third electrode EL3_1, and the fourth electrode EL4_1 and one end of each of the fifth electrode EL5, the sixth electrode EL6, the seventh electrode EL7, and the eighth electrode EL8 may be located in the open area OA within the emission area EMA. The open area OA may correspond to the area center of the emission area EMA.

In the process of manufacturing the display device, before the light emitting elements LD are supplied on the substrate, the first electrode EL1_1, the second electrode EL2_1, the third electrode EL3_1, and the fourth electrode EL4_1 may be provided integrally with the fifth electrode EL5, the sixth electrode EL6, the seventh electrode EL7, and the eighth electrode EL8, respectively. After the light emitting elements LD are supplied and disposed in the pixel area PXA, the first electrode EL1_1, the second electrode EL2_1, the third electrode EL3_1, and the fourth electrode EL4_1 may be respectively separated from the fifth electrode EL5, the sixth electrode EL6, the seventh electrode EL7, and the eighth electrode EL8 in the open area OA (and the second opening OP2 of the bank BNK).

Because the first electrode EL1_1, the second electrode EL2_1, the third electrode EL3_1, and the fourth electrode EL4_1 are respectively symmetrical with the fifth electrode EL5, the sixth electrode EL6, the seventh electrode EL7, and the eighth electrode EL8 based on the open area OA, the following description will focus on the fifth electrode EL5, the sixth electrode EL6, the seventh electrode EL7, and the eighth electrode EL8.

The fifth electrode EL5 may have a shape curved in the first direction DR1 toward the sixth electrode EL6 in the emission area EMA. The curved shape of the fifth electrode EL5 may be provided for maintaining a distance between the fifth electrode EL5 and the sixth electrode EL6 at an interval (e.g., a set or predetermined interval) in the emission area EMA. Similarly, the eighth electrode EL8 may have a shape curved in a direction opposite to the first direction DR1 toward the seventh electrode EL7 in the emission area EMA. The curved shape of the eighth electrode EL8 may be provided for maintaining a distance between the seventh electrode EL7 and the eighth electrode EL8 at an interval (e.g., a set or predetermined interval) in the emission area EMA. However, the fifth electrode EL5 and the eighth electrode EL8 are not limited thereto. For example, each of the fifth electrode EL5 and the eighth electrode EL8 may include the protrusion described above with reference to FIG. 3, instead of the curved shape.

The fifth electrode EL5 may be connected through a first contact hole CNT1 to the first transistor T1 described above with reference to FIG. 9, and the seventh electrode EL7 may be connected through a second contact hole CNT2 to the second power line PL2 described above with reference to FIG. 9.

The structure (e.g., the single layer structure or the multilayer structure) of each of the first electrode EL1_1, the second electrode EL2_1, the third electrode EL3_1, the fourth electrode EL4_1, the fifth electrode EL5, the sixth electrode EL6, the seventh electrode EL7, and the eighth electrode EL8 may be substantially identical to or similar to the structure of the first to fourth electrodes EL1, EL2, EL3, and EL4 described above with reference to FIG. 3.

According to an embodiment, the pixel PXL_2 may include a first bank pattern BNKP1_1 overlapping a region of the first electrode EL1_1 in the emission area EMA, a second bank pattern BNKP2_1 overlapping a region of the second electrode EL2_1 in the emission area EMA, a third bank pattern BNKP3_1 overlapping a region of the third electrode EL3_1 in the emission area EMA, a fourth bank pattern BNKP4_1 overlapping a region of the fourth electrode EL4_1 in the emission area EMA, a fifth bank pattern BNKP5 overlapping a region of the fifth electrode EL5 in the emission area EMA, a sixth bank pattern BNKP6 overlapping a region of the sixth electrode EL6 in the emission area EMA, a seventh bank pattern BNKP7 overlapping a region of the seventh electrode EL7 in the emission area EMA, and an eighth bank pattern BNKP8 overlapping a region of the eighth electrode EL8 in the emission area EMA.

The first bank pattern BNKP1_1, the second bank pattern BNKP2_1, the third bank pattern BNKP3_1, the fourth bank pattern BNKP4_1, the fifth bank pattern BNKP5, the sixth bank pattern BNKP6, the seventh bank pattern BNKP7, and the eighth bank pattern BNKP8 may be spaced from each other in the emission area EMA, and may protrude the region of each of the first electrode EL1_1, the second electrode EL2_1, the third electrode EL3_1, the fourth electrode EL4_1, the fifth electrode EL5, the sixth electrode EL6, the seventh electrode EL7, and the eighth electrode EL8 in the upward direction (e.g., in the thickness direction of the substrate).

The pixel PXL_2 may include a first light emitting element LD1, a second light emitting element LD2, a third light emitting element LD3, and a fourth light emitting element LD4. Because the first light emitting element LD1 and the second light emitting element LD2 are substantially identical to or similar to the first light emitting element LD1 and the second light emitting element LD2 described above with reference to FIG. 3, redundant descriptions thereof will not be repeated.

The third light emitting element LD3 may be disposed between the fifth electrode EL5 and the sixth electrode EL6. A first end EP1 (or one end) of the third light emitting element LD3 may face the fifth electrode EL5, and a second end EP2 (or the other end) of the third light emitting element LD3 may face the sixth electrode EL6. When a plurality of third light emitting elements LD3 are provided, the plurality of third light emitting elements LD3 may be connected in parallel between the fifth electrode EL5 and the sixth electrode EL6 and may constitute the third stage SET3 described above with reference to FIG. 9.

The fourth light emitting element LD4 may be disposed between the seventh electrode EL7 and the eighth electrode EL8. A first end EP1 of the fourth light emitting element LD4 may face the eighth electrode EL8, and a second end EP2 of the fourth light emitting element LD4 may face the seventh electrode EL7. The first end EP1 of the third light emitting element LD3 and the first end EP1 of the fourth light emitting element LD4 may include the same type of semiconductor layers (e.g., p-type semiconductor layers). When a plurality of fourth light emitting elements LD4 are provided, the plurality of fourth light emitting elements LD4 may be connected in parallel between the seventh electrode EL7 and the eighth electrode EL8 and may constitute the fourth stage SET4 described above with reference to FIG. 9.

According to an embodiment, each of the first light emitting element LD1, the second light emitting element LD2, the third light emitting element LD3, and the fourth light emitting element LD4 may be a light emitting diode having an ultra-small size (e.g., a size as small as nanoscale to microscale) using a material having an inorganic crystal structure.

According to some embodiments, the pixel PXL_2 may include a first contact electrode CNE1, a second contact electrode CNE2, a first center electrode CTE1, a second center electrode CTE2, and a third center electrode CTE3.

The first contact electrode CNE1 may be formed on the first end EP1 of the third light emitting element LD3 and at least one region of the fifth electrode EL5 corresponding thereto, and may physically and/or electrically connect the first end EP1 of the third light emitting element LD3 to the fifth electrode EL5.

The second contact electrode CNE2 may be formed on the second end EP2 of the fourth light emitting element LD4 and at least one region of the seventh electrode EL7 corresponding thereto, and may physically and/or electrically connect the second end EP2 of the fourth light emitting element LD4 to the seventh electrode EL7.

The first center electrode CTE1 may include a (1-1)-th center electrode CTE1-1 and a (1-2)-th center electrode CTE1-2 extending in the second direction DR2. The (1-1)-th center electrode CTE1-1 may be formed on the second end EP2 of the third light emitting element LD3 and at least one region of the sixth electrode EL6 corresponding thereto. The first center electrode CTE1 may extend from the sixth electrode EL6 (or the (1-1)-th center electrode CTE1-1) to the first electrode EL1_1 (or the (1-2)-th center electrode CTE1-2), and the (1-2)-th center electrode CTE1-2 may be formed on the first end of the first light emitting element LD1 and at least one region of the first electrode EL1_1 corresponding thereto. The first center electrode CTE1 may electrically connect the second end EP2 of the third light emitting element LD3 to the first end of the first light emitting element LD1.

The second center electrode CTE2 may include a (2-1)-th center electrode CTE2-1 and a (2-2)-th center electrode CTE2-2 extending in the second direction DR2. The (2-1)-th center electrode CTE2-1 may be formed on the second end of the first light emitting element LD1 and at least one region of the second electrode EL2_1 corresponding thereto. The second center electrode CTE2 may extend from the second electrode EL2_1 to bypass (e.g. go around) a (3-1)-th center electrode CTE3-1, and the (2-2)-th center electrode CTE2-2 may be formed on the first end of the second light emitting element LD2 and at least one region of the fourth electrode EL4_1 corresponding thereto. The second center electrode CTE2 may electrically connect the second end of the first light emitting element LD1 to the first end of the second light emitting element LD2.

The third center electrode CTE3 may include the (3-1)-th center electrode CTE3-1 and a (3-2)-th center electrode CTE3-2 extending in the second direction DR2. The (3-1)-th center electrode CTE3-1 may be formed on the second end of the second light emitting element LD2 and at least one region of the third electrode EL3_1 corresponding thereto. The third center electrode CTE3 may extend from the third electrode EL3_1 (or the (3-1)-th center electrode CTE3-1) to the eighth electrode EL8 (or the (3-2)-th center electrode CTE3-2), and the (3-2)-th center electrode CTE3-2 may be formed on the first end EP1 of the fourth light emitting element LD4 and at least one region of the eighth electrode EL8 corresponding thereto. The third center electrode CTE3 may electrically connect the second end of the second light emitting element LD2 to the first end EP1 of the fourth light emitting element LD4.

Therefore, the third light emitting element LD3, the first light emitting element LD1, the second light emitting element LD2, and the fourth light emitting element LD4 may be sequentially connected in series.

During each frame period, in the pixel PXL_2, the first driving current may flow from the fifth electrode EL5 to the seventh electrode EL7 through the third light emitting element LD3, the first center electrode CTE1, the first light emitting element LD1, the second center electrode CTE2, the second light emitting element LD2, the third center electrode CTE3, and the fourth light emitting element LD4.

Figures 11, 12:
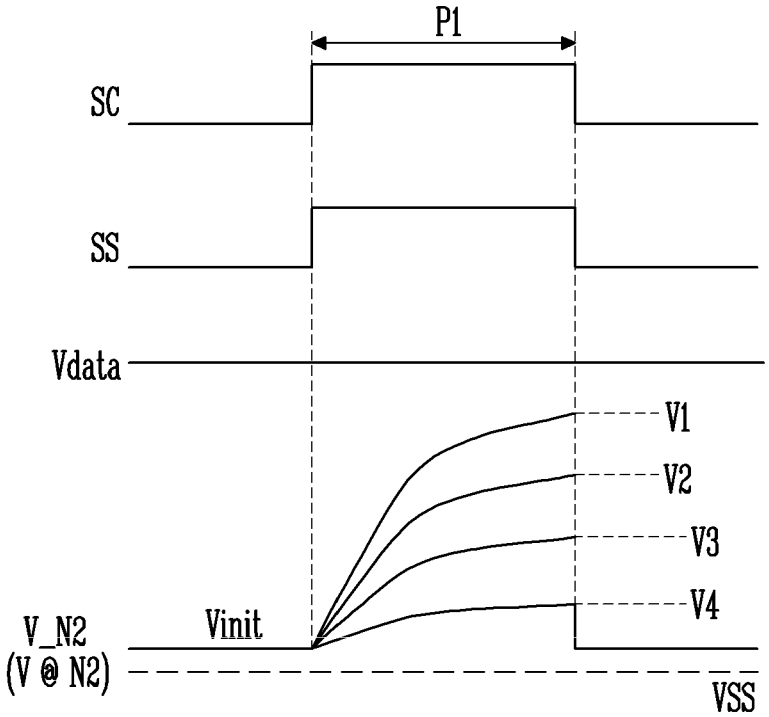
FIG. 11 is a waveform diagram illustrating an example of signals measured in the pixel of FIG. 9.
FIG. 12 is a diagram illustrating an example of the lookup table including stack number information used in the display device of FIG. 1.

FIG. 11 is a waveform diagram illustrating an example of signals measured in the pixel of FIG. 9. FIG. 11 illustrates a waveform diagram corresponding to FIGS. 4 and 6.

Referring to FIGS. 1, 4, 6, 9, and 11, a scan signal SC, a sensing scan signal SS, and a data signal Vdata illustrated in FIG. 11 may be substantially identical to or similar to the scan signal SC, the sensing scan signal SS, and the data signal Vdata described above with reference to FIG. 4, respectively. Therefore, redundant descriptions thereof will not be repeated.

The data voltage Vdata may be set to be lower than the total operating voltage of the four stages SET1_1, SET2_1, SET3, and SET4, and may be set to be higher than the total operating voltage of the three stages, that is, stages excluding one stage from the four stages SET1_1, SET2_1, SET3, and SET4. For example, the data voltage Vdata may have a voltage level of about 9 V (i.e., a value less than 2.5 V (operating voltage of each stage)*4).

The initialization voltage Vinit is applied from the sensing driver 140 to the sensing line RLj at the start of the first period P1, and the supply of the initialization voltage Vinit may be cut off until the end of the first period P1.

In this case, the first transistor T1 supplies a current corresponding to a gate-source voltage to the second node N2. Therefore, the node voltage V_N2 of the second node N2 may increase linearly.

When all the stages SET1_1, SET2_1, SET3, and SET4 of the pixel PXL_2 constitute the effective light source (i.e., when no short-circuit occurs in the stages SET1_1, SET2_1, SET3, and SET4), the node voltage V_N2 of the second node N2 may increase to the first voltage level V1. As described above with reference to FIG. 4, the node voltage V_N2 of the second node N2 may increase to the first voltage level V1 corresponding to a difference between the data signal Vdata and the threshold voltage Vth of the first transistor T1 (i.e., Vdata−Vth).

When the short-circuit occurs in one of the stages SET1_1, SET2_1, SET3, and SET4 of the pixel PXL_2, the node voltage V_N2 of the second node N2 may increase only to the second voltage level V2. Because three of the stages SET1_1, SET2_1, SET3, and SET4 constitute the effective light source, the second voltage level V2 is equal to the total operating voltage of the three stages. For example, the second voltage level V2 may have a voltage level of 7.5 V (i.e., 2.5 V (threshold voltage of each stage)*3) based on the second power supply voltage VSS.

When the short-circuit occurs in two of the stages SET1_1, SET2_1, SET3, and SET4 of the pixel PXL_2, the node voltage V_N2 of the second node N2 may increase only to the third voltage level V3. Because the remaining two of the stages SET1_1, SET2_1, SET3, and SET4 constitute the effective light source, the third voltage level V3 is equal to the total operating voltage of the two stages. For example, the third voltage level V3 may have a voltage level of 5.0 V (i.e., 2.5 V (threshold voltage of each stage)*2) based on the second power supply voltage VSS.

When the short-circuit occurs in three of the stages SET1_1, SET2_1, SET3, and SET4 of the pixel PXL_2, the node voltage V_N2 of the second node N2 may increase only to the fourth voltage level V4. Because the remaining one of the stages SET1_1, SET2_1, SET3, and SET4 constitutes the effective light source, the fourth voltage level V4 is equal to the operating voltage of the one stage. For example, the fourth voltage level V4 may have a voltage level of 2.5 V based on the second power supply voltage VSS.

When the short-circuit occurs in all the stages SET1_1, SET2_1, SET3, and SET4 of the pixel PXL_2, the second node N2 is connected to the second power line PL2. Therefore, the node voltage V_N2 of the second node N2 may be equal to the second power supply voltage VSS.

In some embodiments, the compensator 160 may set stack number information of the pixels PXL_2 by comparing the voltage (or sensing voltage) sensed in the first period P1 with the plurality of reference ranges.

In an embodiment, when the sensed voltage is within the first reference range, the compensator 160 may set the value of the stack number information to the largest first value. For example, when the sensed voltage has the first voltage level V1 and the first reference range is greater than 7.5 V and less than or equal to 10 V, the value of the stack number information may be set to 4, which is the maximum value.

In an embodiment, when the sensed voltage is within the second reference range, the compensator 160 may set the value of the stack number information to a second value, which is smaller than the first value. For example, when the sensed voltage has the second voltage level V2 and the second reference range is greater than 5.0 V and less than or equal to 7.5 V, the value of the stack number information may be set to 3, which is smaller than the maximum value.

In an embodiment, when the sensed voltage is within the third reference range, the compensator 160 may set the value of the stack number information to a third value, which is smaller than the second value. For example, when the sensed voltage has the third voltage level V3 and the third reference range is greater than 2.5 V and less than or equal to 5.0 V, the value of the stack number information may be set to 2.

In an embodiment, when the sensed voltage is within the fourth reference range, the compensator 160 may set the value of the stack number information to a fourth value, which is smaller than the third value. For example, when the sensed voltage has the fourth voltage level V4 and the fourth reference range is greater than 0 V and less than or equal to 2.5 V, the value of the stack number information may be set to 1.

In an embodiment, when the sensed voltage is equal to the second power supply voltage VSS, the compensator 160 may set the value of the stack number information to 0.

As described above with reference to FIG. 11, the display device 100 may determine whether the defect (for example, the short-circuit that has great influence on the luminance change) has occurred in the pixel PXL_2, based on the sensing voltage obtained by sensing the threshold voltage of the first transistor T1 (or the driving transistor), and may set stack number information of the pixel PXL_2.

FIG. 12 is a diagram illustrating another example of a lookup table including stack number information used in the display device of FIG. 1.

Referring to FIGS. 1, 9, and 12, a lookup table LUT_1 may include stack number information INFO_S of each of the pixels PXL.

The lookup table LUT 1 may include first stack number information INFO_S1 of a first pixel PXL1 located in the first row and the first column, second stack number information INFO_S2 of a second pixel PXL2 located in the first row and the second column, third stack number information INFO_S3 of a pixel PXL located in the first row and the third column, and fourth stack number information INFO_S4 of a pixel PXL located in the second row and the third column.

When the value of the first stack number information INFO_S1 is 4, all the four stages in the first pixel PXL1 may constitute the effective light source. The number of stages that do not contribute to constituting the effective light source may be 0, which is given in parentheses.

When the value of the second stack number information INFO_S2 is 3, only three of the four stages in the pixel PXL2 may constitute the effective light source. The number of stages that do not contribute to constituting the effective light source may be 1.

When the value of the third stack number information INFO_S3 is 2, only two of the four stages in the pixel PXL may constitute the effective light source. The number of stages that do not contribute to constituting the effective light source may be 2.

When the value of the fourth stack number information INFO_S4 is 1, only one of the four stages in the pixel PXL may constitute the effective light source. The number of stages that do not contribute to constituting the effective light source may be 3.

In an embodiment, the stack number information INFO_S may indicate the number of some stages (e.g., defective stages) that do not contribute to constituting the effective light source from among the stages of the pixel PXL.

On the other hand, the compensator 160 may determine grayscale conversion equations corresponding to the reference curve CURVE_REF, the first curve CURVE1, and the second curve CURVE2 described above with reference to FIG. 8 based on the stack number information INFO_S (or the lookup table LUT_1), and may compensate the input grayscale GRAY_IN using the grayscale conversion equations to generate the output grayscale GRAY_OUT (or compensated grayscale).

Figure 13:
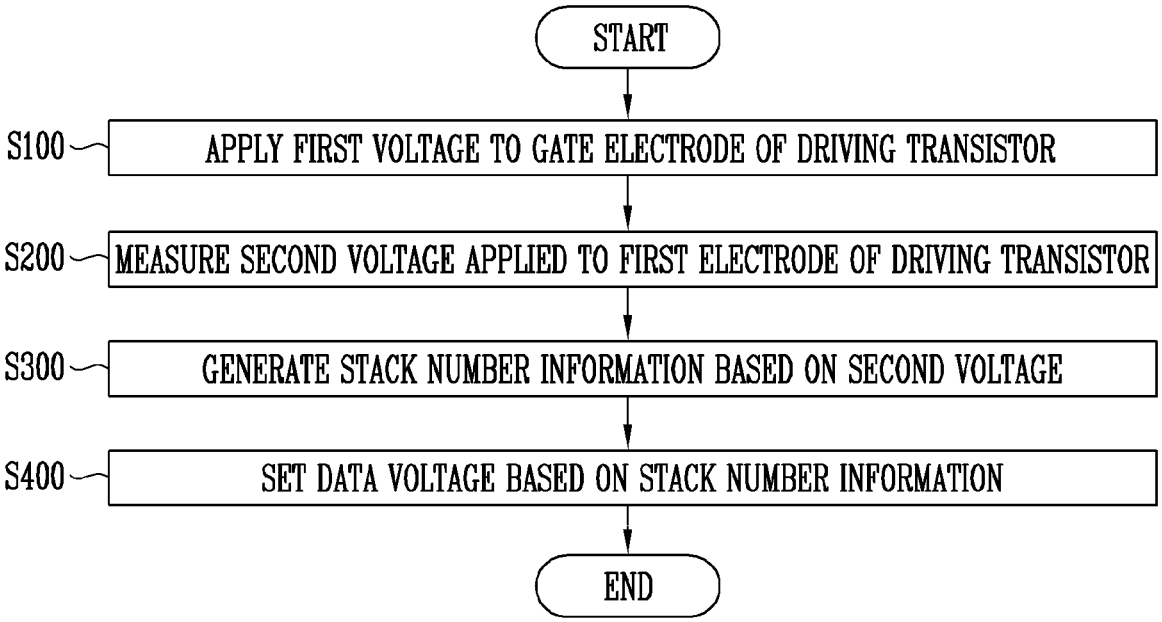
FIG. 13 is a flowchart illustrating a method of driving a display device, according to embodiments of the present disclosure.
Figure 14:
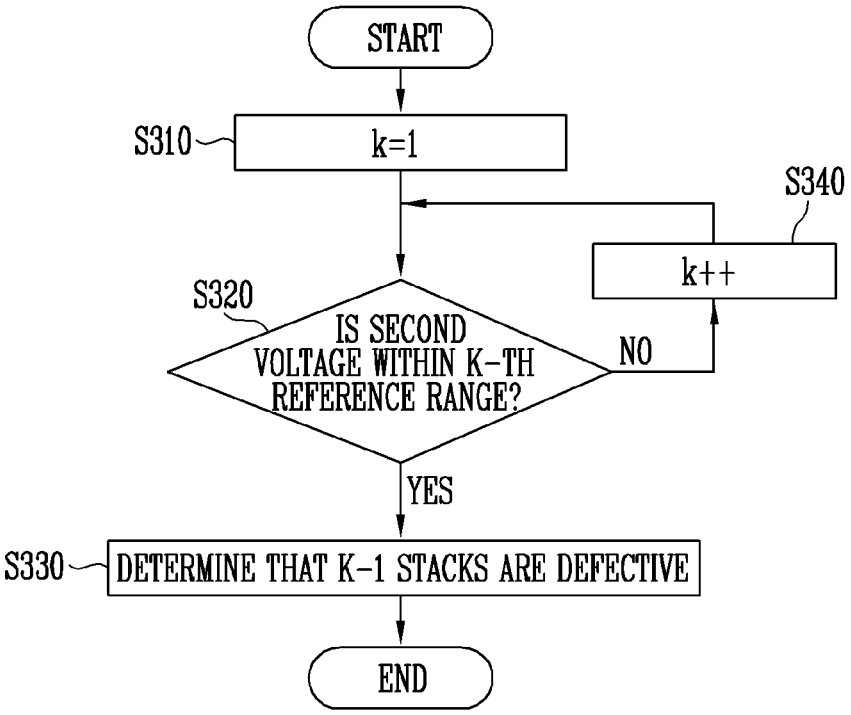
FIG. 14 is a flowchart illustrating an example of generating stack number information included in the method of FIG. 13.

FIG. 13 is a flowchart illustrating a method of driving a display device, according to some embodiments of the present disclosure. FIG. 14 is a flowchart illustrating an example of generating stack number information, which is included in the method of FIG. 13.

Referring to FIGS. 1, 2, 13, and 14, the method of FIG. 13 may be performed by the display device 100 of FIG. 1.

As described above with reference to FIGS. 2 and 9, the display device 100 may include the pixels PXL and PXL_2, the pixels PXL and PXL_2 may include the driving transistor (or the first transistor T1) and the stages (or stacks) connected to the first electrode of the driving transistor, and each of the stages may include at least one light emitting element LD.

The method of FIG. 13 may include applying the first voltage (or the reference voltage) to the gate electrode of the driving transistor of the pixel PXL (S100).

As described above with reference to FIG. 4, when the scan signal SC has the gate-on voltage level in the first period P1, the data voltage Vdata may be applied to the gate electrode of the driving transistor (i.e., the first transistor T1).

The first voltage may be set to be lower than the total operating voltage of the stages so that the light emitting elements LD in the stages do not emit light.

The method of FIG. 13 may measure or sense the second voltage applied to the first electrode of the driving transistor (i.e., the node voltage V_N2 of the second node N2) in response to the first voltage (S200).

As described above with reference to FIG. 4, the initialization voltage Vinit may be applied from the sensing driver 140 to the sensing line RLj at the start of the first period P1, and then the supply of the initialization voltage Vinit from the sensing driver 140 is cut off until the end of the first period P1.

In this case, the current corresponding to the gate-source voltage of the driving transistor may be supplied to the second node (see N2 of FIG. 2), and the node voltage V_N2 of the second node N2 may increase linearly. The node voltage V_N2 of the second node N2 may be sensed through the sensing driver 140 at the end of the first period P1 or after the first period P1.

The method of FIG. 13 may generate the stack number information based on the second voltage (S300).

As described above with reference to FIGS. 4, 6, and 11, the node voltage V_N2 of the second node N2 may have one of the first, second, third, and fourth voltage levels V1, V2, V3, and V4 according to the number of stages constituting the effective light source from among the stages (or the number of defective stages). The compensator 160 may compare the second voltage (i.e., the voltage sensed in the first period P1 or the sensed voltage) with the plurality of reference ranges and set the stack number information of the pixel PXL.

In an embodiment, when the second voltage is within the first reference range, the method of FIG. 13 may set the value of the stack number information to the largest first value. Here, as described above with reference to FIGS. 4 and 11, the first reference range may be set based on the total number of stages and the threshold voltage of the light emitting element LD.

In an embodiment, the method of FIG. 13 may set the value of the stack number information to the second value smaller than the first value when the second voltage is out of the first reference range.

In some embodiments, the method of FIG. 13 may compare the second voltage with the plurality of reference ranges and set the stack number information.

Referring to FIG. 14, the method of FIG. 13 may determine whether the second voltage is within a k-th reference range (S320). Here, the initial value of the constant k may be set to 1 (S310).

When the second voltage is within the k-th reference range, the method of FIG. 13 may determine that k−1 stacks are defective (S330).

For example, as described above with reference to FIG. 11, when the second voltage (e.g., the first voltage level V1) is within the first reference range, it may be determined that 0 stacks are defective, and the stack number information may be set to have the first value (e.g., 4).

When the second voltage is out of the k-th reference range, the method of FIG. 13 may increase k (i.e., k++) (S340), and it may be determined again whether the second voltage is within the k-th reference range (S320).

For example, as described above with reference to FIG. 11, when the second voltage (e.g., the second voltage level V1) is out of the first reference range, the method of FIG. 13 may determine again whether the second voltage is within the second reference range. In this way, the method of FIG.

13 may compare the second voltage with the plurality of reference ranges and set the stack number information based on the comparison result.

Referring back to FIG. 13, the method of FIG. 13 may set the data voltage applied to the gate electrode of the driving transistor based on the stack number information (S400).

As described above with reference to FIGS. 1, 7, and 8, when the first stack number information INFO_S1 of the first pixel PXL1 has a value different from the second stack number information INFO_S2 of the second pixel PXL2, the compensator 160 may differently compensate the first grayscale value of the first pixel and the second grayscale value of the second pixel with respect to the same luminance. Thus, the first data voltage applied to the first pixel PXL1 may be different from the second data voltage applied to the second pixel PXL2.

In an embodiment, as the second stack number information of the second pixel PXL2 decreases, the second data voltage for the same luminance may increase and the driving current (or the total driving current) flowing through the light emitting elements LD of the second pixel PXL2 may increase. That is, as the second stack number information of the second pixel PXL2 decreases, the second grayscale value of the second pixel PXL2 may be greatly compensated compared with the first grayscale value of the first pixel PXL1, the second data voltage increases according to the relatively large second grayscale value (i.e., the second compensated grayscale value), and the driving current corresponding to the second data voltage may increase.

In an embodiment, when the first stack number information of the first pixel PXL1 has a value greater than that of the second stack number information of the second pixel PXL2, the compensator 160 may generate the first compensated grayscale value by downscaling the first grayscale value of the first pixel PXL1 based on the second grayscale value of the second pixel PXL2.

In an embodiment, when the first stack number information of the first pixel PXL1 has a value greater than that of the second stack number information of the second pixel PXL2, the compensator 160 may generate the second compensated grayscale value by upscaling the second grayscale value of the second pixel PXL2 based on the first grayscale value of the first pixel PXL1.

In an embodiment, when the first stack number information of the first pixel PXL1 has a value greater than that of the second stack number information of the second pixel PXL2, the compensator 160 may generate the first compensated grayscale value by downscaling the first grayscale value of the first pixel PXL1 and may generate the second compensated grayscale value by upscaling the second grayscale value of the second pixel PXL2.

That is, the method of FIG. 13 may decrease the first grayscale value of the first pixel PXL1 corresponding to the relatively large first stack number information, or may increase the second grayscale value of the second pixel PXL2 corresponding to the relatively small second stack number information.

Therefore, the data voltage applied to the first pixel PXL1 and the driving current corresponding thereto may decrease, or the data voltage applied to the second pixel PXL2 and the driving current corresponding thereto may increase, and the difference in luminance between the first pixel PXL1 and the second pixel PXL2, which is caused by the difference in the number of stacks (i.e., the difference deviation in the number of stages constituting the effective light source) may be improved.

Figure 15:
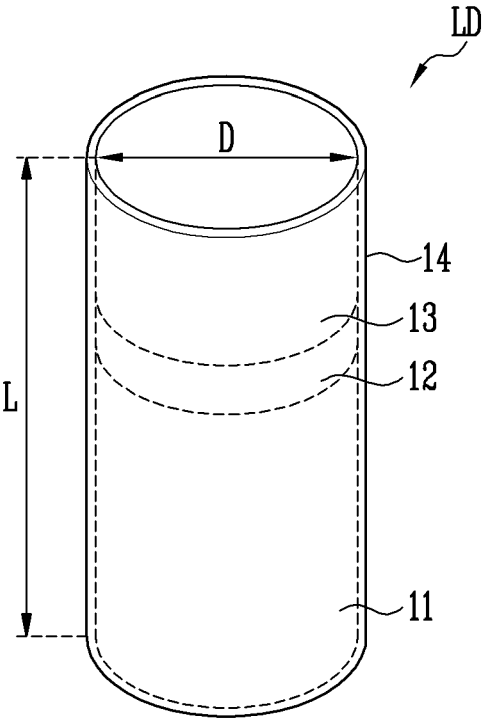
FIG. 15 is a perspective view schematically illustrating a light emitting element used as a light source in the display device of FIG. 1.
Figure 16:
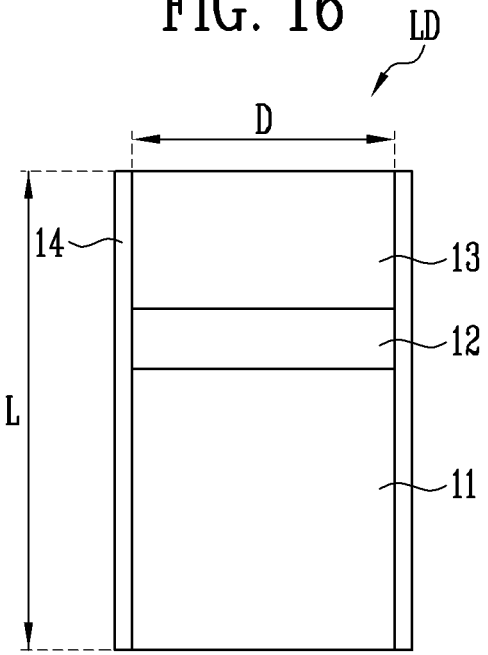
FIG. 16 is a cross-sectional view of the light emitting element of FIG. 15.

FIG. 15 is a schematic perspective view illustrating the light emitting element used as the light source in the display device of FIG. 1. FIG. 16 is a cross-sectional view of the light emitting element of FIG. 15.

In an embodiment of the present disclosure, the type and/or the shape of the light emitting element is not limited to the embodiments illustrated in FIGS. 15 and 16.

Referring to FIGS. 15 and 16, the light emitting element LD may include a first semiconductor layer 11, a second semiconductor layer 13, and an active layer 12 disposed between the first semiconductor layer 11 and the second semiconductor layer 13. For example, the light emitting element LD may implement a light emitting stack in which the first semiconductor layer 11, the active layer 12, and the second semiconductor layer 13 are sequentially stacked.

The light emitting element LD may be provided in a shape extending in one direction. When the extending direction of the light emitting element LD is the longitudinal direction, the light emitting element LD may include one end (or a lower end) and the other end (or an upper end) in the extending direction. Any one of the first and second semiconductor layers 11 and 13 may be disposed at one end (or the lower end) of the light emitting element LD, and the remaining one of the first and second semiconductor layers 11 and 13 may be disposed at the other end (or the upper end) of the light emitting element LD. For example, the first semiconductor layer 11 may be disposed at one end (or the lower end) of the light emitting element LD, and the second semiconductor layer 13 may be disposed at the other end (or the upper end) of the light emitting element LD.

The light emitting element LD may be provided in various shapes. For example, the light emitting element LD may have a rod-like shape or a bar-like shape that is long in the longitudinal direction (i.e., the aspect ratio is greater than 1). In an embodiment of the present disclosure, a length L of the light emitting element LD in the longitudinal direction may be greater than a diameter (D, or a width of a cross-section) thereof. Such a light emitting element LD may include, for example, a light emitting diode (LED) manufactured in a very small size to have a diameter (D) and/or a length (L) of about micro scale or nano scale.

The diameter D of the light emitting element LD may be about 0.5 μm to about 5 μm, and the length L of the light emitting element LD may be about 1 μm to about 10 μm. However, the diameter D and length L of the light emitting element LD are not limited thereto, and the size of the light emitting element LD may be changed to meet the requirements (or design conditions) of a lighting device or a self-luminous display device to which the light emitting element LD is applied.

The first semiconductor layer 11 may include, for example, at least one n-type semiconductor layer. For example, the first semiconductor layer 11 may include one semiconductor material selected from InAlGaN, GaN, AlGaN, InGaN, AlN, and InN, and may be an n-type semiconductor layer doped with a first conductive dopant (or an n-type dopant) such as Si, Ge, and Sn. However, the material forming the first semiconductor layer 11 is not limited thereto, and the first semiconductor layer 11 may be formed using various other materials. In an embodiment of the present disclosure, the first semiconductor layer 11 may include a gallium nitride (GaN) semiconductor material doped with the first conductive dopant (or the n-type dopant). The first semiconductor layer 11 may include an upper surface coming in contact with the active layer 12 in the length (L) direction of the light emitting element LD, and a lower surface exposed to the outside. The lower surface of the first semiconductor layer 11 may be one end (or a lower end) of the light emitting element LD.

The active layer 12 may be disposed on the first semiconductor layer 11 and may be formed in a single or multiple quantum well structure. For example, when the active layer 12 is formed in a multiple quantum well structure, the active layer 12 may include a barrier layer, a strain reinforcing layer, and a well layer, which are periodically repeatedly stacked as one unit. The strain reinforcing layer has a smaller lattice constant than that of the barrier layer, so that the strain applied to the well layer, for example, the compression strain may be further reinforced. However, the structure of the active layer 12 is not limited to the above-described embodiment.

The active layer 12 may emit light having a wavelength of 400 nm to 900 nm, and may use a double hetero structure. In an embodiment of the present disclosure, a clad layer (not illustrated) doped with a conductive dopant may be formed above and/or under the active layer 12 in the length (L) direction of the light emitting element LD. For example, the clad layer may be formed using an AlGaN layer or an InAlGaN layer. According to an embodiment, a material such as AlGaN or InAlGaN may be used to form the active layer 12, and various other materials may constitute the active layer 12. The active layer 12 may include a first surface coming in contact with the first semiconductor layer 11 and a second surface coming in contact with the second semiconductor layer 13.

When an electric field corresponding to a voltage (e.g., a set or predetermined voltage or more) is applied between both ends of the light emitting element LD, electron-hole pairs are recombined in the active layer 12 to cause the light emitting element LD to emit light. By controlling the light emission of the light emitting element LD using this principle, the light emitting element LD may be used as light sources (or light emitting sources) of various light emitting devices including pixels of display devices.

The second semiconductor layer 13 may be disposed on the second surface of the active layer 12 and may include a different type of a semiconductor layer from that of the first semiconductor layer 11. For example, the second semiconductor layer 13 may include at least one p-type semiconductor layer. For example, the second semiconductor layer 13 may include at least one semiconductor material selected from InAlGaN, GaN, AlGaN, InGaN, AlN, and InN, and may be a p-type semiconductor layer doped with a second conductive dopant (or a p-type dopant) such as Mg. However, the material forming the second semiconductor layer 13 is not limited thereto, and the second semiconductor layer 13 may be formed using various other materials. In an embodiment of the present disclosure, the second semiconductor layer 13 may include a gallium nitride (GaN) semiconductor material doped with the second conductive dopant (or the p-type dopant). The second semiconductor layer 13 may include a lower surface coming in contact with the second surface of the active layer 12 in the length (L) direction of the light emitting element LD, and an upper surface exposed to the outside. Here, the upper surface of the second semiconductor layer 13 may be the other end (or the upper end) of the light emitting element LD.

In an embodiment of the present disclosure, the first semiconductor layer 11 and the second semiconductor layer 13 may have different thicknesses in the length (L) direction of the light emitting element LD. For example, the first semiconductor layer 11 may have a relatively large thickness than that of the second semiconductor layer 13 in the length (L) direction of the light emitting element LD. Therefore, the active layer 12 of the light emitting element LD may be located closer to the upper surface of the second semiconductor layer 13 than the lower surface of the first semiconductor layer 11.

Although each of the first semiconductor layer 11 and the second semiconductor layer 13 is illustrated as including one layer, the present disclosure is not limited thereto. In an embodiment of the present disclosure, each of the first semiconductor layer 11 and the second semiconductor layer 13 may further include at least one layer, for example a clad layer and/or a tensile strain barrier reducing (TSBR) layer according to the material of the active layer 12. The TSBR layer may be a strain alleviating layer that is disposed between semiconductor layers having different lattice structures and serves as a buffer for reducing a difference in lattice constant. The TSBR layer may include a p-type semiconductor layer such as p-GaInP, p-AlInP, or p-AlGaInP, but the present disclosure is not limited thereto.

According to an embodiment, the light emitting element LD may further include an additional electrode (not illustrated) (hereinafter, referred to as a "first additional electrode") disposed on the second semiconductor layer 13, in addition to the first semiconductor layer 11, the active layer 12, and the second semiconductor layer 13 described above. In an embodiment, another additional electrode (hereinafter, referred to as a "second additional electrode") disposed at one end of the first semiconductor layer 11 may be further included.

Each of the first and second additional electrodes may be an ohmic contact electrode, but the present disclosure is not limited thereto. According to an embodiment, each of the first and second additional electrodes may be a Schottky contact electrode. Each of the first and second additional electrodes may include a conductive material (or substance). For example, each of the first and second additional electrodes may include an opaque metal in which chromium (Cr), titanium (Ti), aluminum (Al), gold (Au), nickel (Ni), and oxides or alloys thereof are used alone or in combination, but the present disclosure is not limited thereto. According to an embodiment, each of the first and second additional electrodes may include a transparent conductive oxide, such as indium tin oxide (ITO), indium zinc oxide (IZO), zinc oxide (ZnO), indium gallium zinc oxide (ITZO), or indium tin zinc oxide (ITZO).

Materials included in the first and second additional electrodes may be identical to or different from each other. The first and second additional electrodes may be substantially transparent or semitransparent. Therefore, light generated by the light emitting element LD may be transmitted through the first and second additional electrodes and emitted to the outside of the light emitting element LD. According to an embodiment, when light generated by the light emitting element LD is emitted to the outside of the light emitting element LD through an area other than both ends of the light emitting element LD without being transmitted through the first and second additional electrodes, each of the first and second additional electrodes may include an opaque metal.

In an embodiment of the present disclosure, the light emitting element LD may further include an insulating film 14. However, according to some embodiments, the insulating film 14 may be omitted and may be provided to cover only a portion of the first semiconductor layer 11, the active layer 12, and the second semiconductor layer 13.

The insulating film 14 may prevent occurrence of an electrical short-circuit that may occur when the active layer 12 comes in contact with a conductive material other than the first and second semiconductor layers 11 and 13. In some embodiments, the insulating film 14 may reduce or minimize surface defects of the light emitting element LD, thereby improving the lifetime and luminous efficiency of the light emitting element LD. In some embodiments, when the plurality of light emitting elements LD are closely disposed, the insulating film 14 may prevent occurrence of an unwanted short-circuit that may occur between the light emitting elements LD. Whether or not the insulating film 14 is provided is not limited as long as the active layer 12 may prevent occurrence of an short-circuit with an external conductive material.

The insulating film 14 may be provided to entirely surround the outer peripheral surface of the light emitting stack including the first semiconductor layer 11, the active layer 12, and the second semiconductor layer 13.

In the above-described embodiment, the insulating film 14 entirely surrounding the outer peripheral surface of each of the first semiconductor layer 11, the active layer 12, and the second semiconductor layer 13 has been described, but the present disclosure is not limited thereto. According to an embodiment, when the light emitting element LD includes the first additional electrode, the insulating film 14 may entirely surround the outer peripheral surface of each of the first semiconductor layer 11, the active layer 12, the second semiconductor layer 13, and the first additional electrode. In an embodiment, the insulating film 14 may not entirely surround the outer peripheral surface of the first additional electrode, or may surround only a portion of the outer peripheral surface of the first additional electrode and may not surround the other portions of the outer peripheral surface of the first additional electrode. In an embodiment, when the first additional electrode is disposed at the other end (or the upper end) of the light emitting element LD and the second additional electrode is disposed at one end (or the lower end) of the light emitting element LD, the insulating film 14 may expose at least one region of each of the first and second additional electrodes.

The insulating film 14 may include a transparent insulating material. For example, the insulating film 14 may include one or more insulating materials selected from the group consisting of silicon oxide ($SiO_x$), silicon nitride ($SiN_x$), silicon oxynitride (SiON), aluminum oxide ($AlO_x$), and titanium dioxide ($TiO_2$), but the present disclosure is not limited thereto. Various materials having insulating properties may be used as the material of the insulating film 14.

The light emitting element LD described above may be used as light emitting sources of various display devices. The light emitting element LD may be manufactured through a surface treatment process. For example, when a plurality of light emitting elements LD are mixed with a liquid solution (or solvent) and supplied to each pixel area (e.g., the light emitting area of each pixel or the light emitting area of each sub-pixel), each of the light emitting elements LD may be surface-treated so that the light emitting elements LD are uniformly sprayed without non-uniformly aggregating in the solution.

Light emitting units (or light emitting devices) including the light emitting elements LD described above may be used for various types of electronic devices requiring light sources, including display devices. For example, when the plurality of light emitting elements LD are disposed in the pixel area of each pixel of the display panel, the light emitting elements LD may be used as the light source of each pixel. However, the field of application of the light emitting elements LD is not limited to the above-described examples. For example, the light emitting elements LD may be used for other types of electronic devices requiring light sources, such as lighting devices.

The display device and the method of driving the display device according to the described embodiments of the present disclosure may generate stack number information for each pixel and generate compensated data by compensating image data based on the stack number information. Therefore, the deterioration in display quality due to the deviation in the number of stages of pixels (i.e., stages constituting the effective light source) may be alleviated or improved.

In some embodiments, the display device and the method of driving the display device may improve the lifetime of the pixels by compensating (or decreasing) the first grayscale value of the first pixel corresponding to the relatively large first stack number information compared to the second grayscale value of the second pixel corresponding to the relatively small second stack number information.

Furthermore, the display device may improve display quality by compensating (or increasing) the second grayscale value of the second pixel corresponding to the relatively small second stack number information compared to the first grayscale value of the first pixel corresponding to the relatively large first stack number information.

The aspects of the present disclosure are not limited by the contents exemplified above, and more various aspects are included in the present disclosure.

While the present disclosure has been described with reference to various embodiments, it will be understood by those with ordinary skill in the relevant technical field that the present disclosure can be variously modified and changed without departing from the spirit and scope of the present disclosure set forth in the appended claims.

Therefore, the technical scope of the present disclosure should not be limited to the contents described in the detailed description of the present disclosure, but should be determined by the appended claims.

What is claimed is:

1. A display device comprising:

a display unit comprising pixels, wherein each of the pixels comprises stacks connected in series and each of the stacks comprises a light emitting element;

a storage to store pieces of stack number information, wherein each of the pieces of the stack number information indicates a number of stacks constituting an effective light source from among the stacks for each of the pixels;

a compensator to generate compensated data by compensating image data based on the pieces of the stack number information; and a data driver to generate data voltages based on the compensated data and to provide the data voltages to the display unit, wherein the pixels are to emit light with luminances corresponding to the data voltages.

2. The display device of claim 1, wherein the pixels comprise a first pixel and a second pixel, wherein first stack number information of the first pixel has a value different from that of second stack number information of the second pixel, and wherein a first data voltage applied to the first pixel for a same luminance as the second pixel is different from a second data voltage applied to the second pixel.

3. The display device of claim 2, wherein, as the second stack number information decreases, the second data voltage for the same luminance as the first pixel and a driving current flowing through the light emitting element of the second pixel increase.

4. The display device of claim 2, wherein, when the first stack number information is greater than the second stack number information, the compensator is to generate a first compensated grayscale value by downscaling a first grayscale value of the first pixel based on a second grayscale value of the second pixel, wherein the image data comprises the first grayscale value and the second grayscale value, and wherein the compensated data comprises the first compensated grayscale value.

5. The display device of claim 2, wherein, when the first stack number information is greater than the second stack number information, the compensator is to generate a second compensated grayscale value by upscaling a second grayscale value of the second pixel based on a first grayscale value of the first pixel, wherein the image data comprises the first grayscale value and the second grayscale value, and wherein the compensated data comprises the second compensated grayscale value.

6. The display device of claim 1, wherein each of the pixels comprises two stacks.

7. The display device of claim 6, wherein each of the pixels further comprises:

a driving transistor connected between a first power line and a second power line, a switching transistor connected between a data line and a gate electrode of the driving transistor;

a sensing transistor connected between one electrode of the driving transistor and a sensing line; and a storage capacitor connected between the gate electrode of the driving transistor and the one electrode of the driving transistor, and wherein the stacks are connected between the one electrode of the driving transistor and the second power line.

8. The display device of claim 7, wherein the compensator is to set the pieces of the stack number information based on a sensing voltage sensed by the one electrode of the driving transistor in response to a reference voltage applied to the gate electrode of the driving transistor.

9. The display device of claim 8, wherein, when the sensing voltage is within a reference range, the compensator is to set corresponding stack number information from among the pieces of the stack number information to have a maximum value.

10. The display device of claim 8, wherein, when the sensing voltage is out of a reference range, the compensator is to set corresponding stack number information from among the pieces of the stack number information to have a value smaller than a maximum value.

11. The display device of claim 10, wherein the sensing voltage is equal to a value obtained by multiplying a threshold voltage of the light emitting element by a value of the corresponding stack number information.

12. The display device of claim 1, wherein each of the pixels comprises four stacks.

13. A method of driving a display device comprising pixels, wherein each of the pixels comprises a driving transistor and stacks connected in series to a first electrode of the driving transistor and each of the stacks comprises a light emitting element, the method comprising:

applying a first voltage to a gate electrode of the driving transistor;

measuring a second voltage applied to the first electrode of the driving transistor in response to the first voltage;

generating stack number information based on the second voltage, wherein the stack number information indicates a number of stacks constituting an effective light source from among the stacks for each of the pixels; and setting a data voltage applied to the gate electrode of the driving transistor based on the stack number information.

14. The method of claim 13, wherein the generating of the stack number information comprises:

when the second voltage is within a first reference range, setting the stack number information to have a first value.

15. The method of claim 14, wherein the first reference range is set based on a total number of the stacks and a threshold voltage of the light emitting element.

16. The method of claim 14, wherein the generating of the stack number information comprises:

when the second voltage is out of the first reference range, setting the stack number information to have a second value smaller than the first value.

17. The method of claim 13, wherein:

the pixels comprise a first pixel and a second pixel, first stack number information of the first pixel has a value different from that of second stack number information of the second pixel, and a first data voltage applied to the first pixel for a same luminance as the second pixel is different from a second data voltage applied to the second pixel.

18. The method of claim 17, wherein, as the second stack number information decreases, the second data voltage for the same luminance as the first pixel and a driving current flowing through the light emitting element of the second pixel increase.

19. The method of claim 17, wherein the setting of the data voltage comprises:

when the first stack number information is greater than the second stack number information, generating a first compensated grayscale value by downscaling a first grayscale value of the first pixel based on a second grayscale value of the second pixel; and generating the first data voltage for the first pixel based on the first compensated grayscale value.

20. The method of claim 17, wherein the setting of the data voltage comprises:

when the first stack number information is greater than the second stack number information, generating a second compensated grayscale value by upscaling a second grayscale value of the second pixel based on a first grayscale value of the first pixel; and generating the second data voltage for the second pixel based on the second compensated grayscale value.

* * * * *